US009548196B2

(12) United States Patent
Tagawa et al.

(10) Patent No.: US 9,548,196 B2
(45) Date of Patent: Jan. 17, 2017

(54) DISCHARGE LAMP

(71) Applicant: USHIO DENKI KABUSHIKI KAISHA, Tokyo (JP)

(72) Inventors: Yukiharu Tagawa, Himeji (JP); Tomoyoshi Arimoto, Himeji (JP); Mitsuo Funakoshi, Himeji (JP); Yukio Yasuda, Himeji (JP); Hirohisa Iwabayashi, Himeji (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/900,357

(22) PCT Filed: Jun. 17, 2014

(86) PCT No.: PCT/JP2014/065963

§ 371 (c)(1),
(2) Date: Dec. 21, 2015

(87) PCT Pub. No.: WO2014/208392

PCT Pub. Date: Dec. 31, 2014

(65) Prior Publication Data

US 2016/0148797 A1 May 26, 2016

(30) Foreign Application Priority Data

Jun. 24, 2013 (JP) ..... 2013-131298
Nov. 22, 2013 (JP) ..... 2013-241899
(Continued)

(51) Int. Cl.
*H01J 17/04* (2012.01)
*H01J 61/073* (2006.01)
(Continued)

(52) U.S. Cl.
CPC ..... *H01J 61/0737* (2013.01); *H01J 9/04* (2013.01); *H01J 61/0732* (2013.01); *H01J 61/0735* (2013.01); *H01J 61/86* (2013.01)

(58) Field of Classification Search
CPC . H01J 61/0737; H01J 61/0735; H01J 61/0732
(Continued)

(56) References Cited

U.S. PATENT DOCUMENTS 7,279,839 B2 10/2007 Menzel et al.
8,695,682 B2 4/2014 Lin
(Continued)

FOREIGN PATENT DOCUMENTS

JP 2732452 B2 3/1998
JP 3175592 B2 6/2001
(Continued)

OTHER PUBLICATIONS

International Search Report—PCT/JP2014/065963 dated Jul. 15, 2014.

*Primary Examiner* — Vip Patel
(74) *Attorney, Agent, or Firm* — Studebaker & Brackett PC

(57) ABSTRACT

A discharge lamp includes a cathode in a luminous tube, and an emitter, other than thorium, is added to the cathode. The emitter is prevented from being excessively vaporized from the cathode and depleted soon. Smooth lighting is enabled even at start-up. A main body part (31) of the cathode (3) is made from a metallic material having a high melting point and containing no thorium. A front end (32) is made from a metallic material having a high melting point and containing an emitter (excepting thorium). Inside a sealed space (33) formed in the main body part (31) and/or the front end part (32) is received a sintered compact (34) containing an
(Continued)

emitter (excepting thorium) that is higher in concentration than the emitter contained in the front end part (32).

17 Claims, 18 Drawing Sheets

(30) Foreign Application Priority Data

| | | |
|---|---|---|
| Feb. 17, 2014 | (JP) | 2014-027468 |
| Feb. 17, 2014 | (JP) | 2014-027470 |
| Mar. 7, 2014 | (JP) | 2014-045188 |
| Mar. 18, 2014 | (JP) | 2014-054375 |
| May 26, 2014 | (JP) | 2014-107802 |
| Jun. 6, 2014 | (JP) | 2014-117277 |

(51) Int. Cl.
*H01J 9/04* (2006.01)
*H01J 61/86* (2006.01)

(58) Field of Classification Search
USPC ..... 313/633, 631, 632
See application file for complete search history.

(56) References Cited

U.S. PATENT DOCUMENTS

| | | | | |
|---|---|---|---|---|
| 2012/0001542 | A1 | 1/2012 | Ikeuchi et al. | |
| 2012/0181925 | A1* | 7/2012 | Arimoto | H01J 61/0732 313/633 |

FOREIGN PATENT DOCUMENTS

| | | | |
|---|---|---|---|
| JP | 2002-141018 | A | 5/2002 |
| JP | 2003/217438 | A | 7/2003 |
| JP | 2005-519435 | A | 6/2005 |
| JP | 2010-153339 | A | 7/2010 |
| JP | 2012-015008 | A | 1/2012 |
| WO | 03/075310 | A1 | 9/2003 |

* cited by examiner

FIG. 2(A)
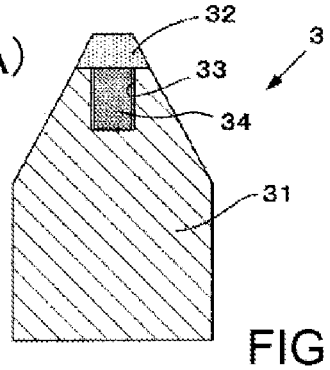
FIG. 2(B)
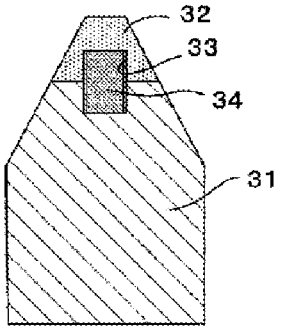
FIG. 2(C)
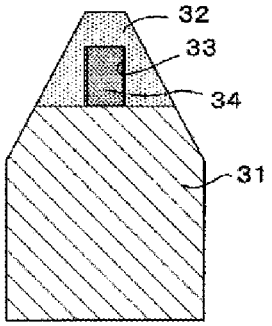
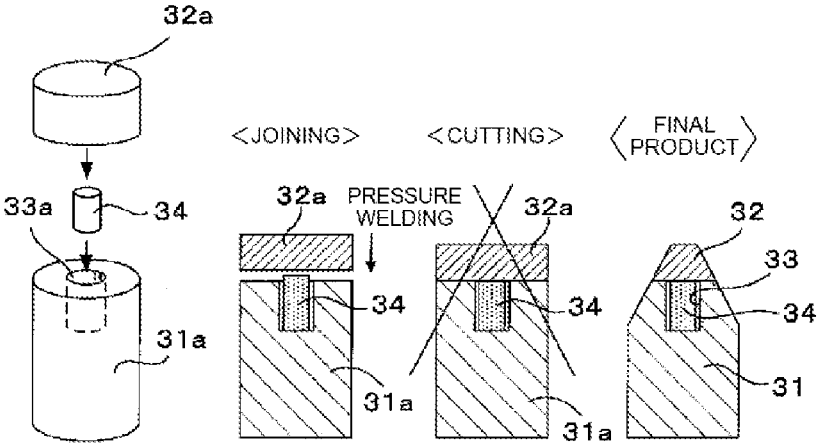
FIG. 3(A) FIG. 3(B) FIG. 3(C) FIG. 3(D)

FIG. 5

<TABLE 1>
<RESULTS OF EXPERIMENTS>

| EMBEDDING POSITION | INITIAL VALUE | AFTER 500-HOUR LIGHTING | | RESULTS OF EXPERIMENTS |
|---|---|---|---|---|
| L | VOLTAGE VARIATION | VOLTAGE VARIATION | ILLUMINANCE PRESERVING FACTOR | |
| (mm) | (V) | (V) | (%) | |
| 1.0 | 0.6 | 0.7 (※) | 40 (※) | LUMINOUS TUBE BECAME CLOUDED DUE TO EMITTER VAPORIZATION<br>(※)MEASUREMENTS WERE STOPPED BECAUSE ILLUMINANCE DROPPED |
| 1.5 | 0.6 | 0.9 | 55 | GOOD<br>MAJOR REASON FOR ILLUMINANCE DROP WAS BLACKENING, WHICH WAS CAUSED BY VAPORIZATION OF TUNGSTEN FROM ANODE FRONT END PART |
| 2.0 | 0.5 | 1.0 | 60 | |
| 2.5 | 0.6 | 1.0 | 62 | |
| 3.0 | 0.5 | 1.1 | 61 | |
| 3.5 | 0.6 | 1.2 | 60 | |
| 4.0 | 0.5 | 1.8 | 50 | LARGE VOLTAGE VARIATION WAS CAUSED BY INSUFFICIENT FEEDING OF EMITTER<br>BLACKENING WAS OBSERVED DUE TO UNSTABLE ARC |

FIG. 6

<TABLE 3>

| | CATHODE FRONT END DIAMETER mm | LAMP POWER kW | LAMP VOLTAGE V | LAMP CURRENT A | CURRENT DENSITY A/mm² | ILLUMINANCE PRESERVING FACTOR /100h % | RESULTS |
|---|---|---|---|---|---|---|---|
| EXAMPLE 1 | 1.4 | 4.7 | 36.5 | 128 | 83 | 98 | ○ |
| EXAMPLE 2 | 0.8 | 1.7 | 36.3 | 47 | 94 | 97 | ○ |
| EXAMPLE 3 | 0.8 | 2.5 | 39.8 | 63 | 126 | 97 | ○ |
| EXAMPLE 4 | 0.6 | 1.5 | 36.7 | 42 | 149 | 96 | ○ |
| EXAMPLE 5 | 0.6 | 1.8 | 37.5 | 47 | 165 | 94 | ○ |
| COMPARISON 1 | 0.6 | 1.9 | 38.6 | 50 | 176 | 52 | × |
| COMPARISON 2 | 0.6 | 2.2 | 39.6 | 55 | 193 | 43 | × |
| COMPARISON 3 | 0.5 | 1.4 | 36.5 | 39 | 199 | 43 | × |
| COMPARISON 4 | 0.5 | 1.6 | 37.4 | 44 | 224 | 37 | × |
| | | | | | | | |
| COMPARISON 5 | 0.6 | 3.0 | 37.0 | 82.0 | 300 | — | × (NOTE) |
| COMPARISON 6 | 0.6 | 3.0 | 37.0 | 82.0 | 300 | 70 | × |

COMPARISON 5: CATHODE WAS MADE FROM CERIUM TUNGSTEN THAT CONTAINED CERIUM OXIDE BY 2% IN A 2mm REGION FROM THE FRONT END

NOTE: FLICKER OCCURRED AFTER 50-HOUR LIGHTING

COMPARISON 6: ENTIRE CATHODE WAS MADE FROM CERIUM TUNGSTEN THAT CONTAINED CERIUM OXIDE BY 2%

FIG. 8

<TABLE 4>

| | RARE EARTH OXIDE | | RARE EARTH COMPLEX OXIDE | | | | | | | | | | | |
|---|---|---|---|---|---|---|---|---|---|---|---|---|---|---|
| | | | $(Rn_2O_3):(WO_3)$ | | $(Rn_2O_3):(ZrO_2)$ | | $(Rn_2O_3):(Ta_2O_5)$ | | $(Rn_2O_3):(MoO_3)$ | | $(Rn_2O_3):(HfO_2)$ | | $(Rn_2O_3):(TiO_2)$ | |
| | COMPOSITION | MELTING POINT (°C) | COMPOSITION | MELTING POINT (°C) | COMPOSITION | MELTING POINT (°C) | COMPOSITION | MELTING POINT (°C) | COMPOSITION | MELTING POINT (°C) | COMPOSITION | MELTING POINT (°C) | COMPOSITION | MELTING POINT (°C) |
| La | $La_2O_3$ | 2315 | 1:2 | 1600 | 3:1 | 2220 | 1:1 | 1930 | 1:2 | 1354 | 1:2 | 2200 | 1:2 | 1790 |
| Ce | $CeO_2$ | 2600 | 3:1 | 2030 | 1:3 | 2400 | 1:1 | 1900 | 1:3 | 1035 | | | | |
| Pr | $Pr_6O_{11}$ | 2000 | 1:1 | 2050 | | | 1:1 | 1900 | 1:3 | 1045 | | | | |
| Nd | $Nd_2O_3$ | 2200 | 1:2 | 1353 | 7:3 | 2100 | 1:1 | 1920 | | | | | | |
| Sm | $Sm_2O_3$ | 2320 | 1:2 | 1690 | 3:1 | 2190 | | | 1:3 | 1085 | 4:1 | 2000 | | |
| Gd | $Gd_2O_3$ | 2310 | 3:1 | 2240 | 1:2 | 2260 | | | 1:3 | 1165 | 4:1 | 2200 | 1:2 | 1820 |

FIG. 10

<TABLE 5>

| | AMOUNT OF ADDITIVE (WEIGHT %) | SPECIFIC RESISTANCE $\rho$ [$\mu\Omega \cdot$ cm] (T=77K) | LAMP LONGEVITY (HOUR) |
|---|---|---|---|
| SAMPLE A | 0. 0 | 0. 55 | 20 |
| SAMPLE B | 0. 1 | 0. 60 | 50 |
| SAMPLE C | 0. 5 | 0. 65 | 100 |
| SAMPLE D | 0. 8 | 0. 70 | 130 |
| SAMPLE E | 1. 5 | 0. 72 | 230 |
| SAMPLE F | 2. 5 | 0. 73 | 530 |
| SAMPLE G | 3. 5 | 0. 77 | 310 |
| SAMPLE H | 5. 0 | 0. 79 | 80 |
| SAMPLE I | 6. 0 | 0. 82 | 30 |

IMMEDIATELY AFTER SINTERING

AFTER SWAGING

INVENTION <Re-W ALLOY PART PRESENT>

COMPARISON <Re-W ALLOY PART ABSENT>

FIG. 17

<TABLE 8>

| | GRAIN BOUNDARY DENSITY (A) (1/mm) | CONCENTRATION GRADIENT $\times 10^{-9}$ (mol/mm$^4$) | A×B $\times 10^{-3}$ (mol/mm$^5$) | LAMP LONGEVITY h | EVALU-ATION |
|---|---|---|---|---|---|
| 1 | 120 | 0.63 | 80 | 80 | × |
| 2 | 120 | 0.75 | 90 | 100 | × |
| 3 | 120 | 0.94 | 110 | 120 | × |
| 4 | 120 | 1.3 | 160 | 170 | × |
| 5 | 120 | 1.9 | 230 | 260 | × |
| 6 | 120 | 3.8 | 460 | 520 | ◎ |
| 7 | 230 | 0.63 | 140 | 160 | × |
| 8 | 230 | 0.75 | 170 | 190 | × |
| 9 | 230 | 0.94 | 220 | 250 | × |
| 10 | 230 | 1.3 | 300 | 350 | ○ |
| 11 | 230 | 1.9 | 440 | 500 | ◎ |
| 12 | 230 | 3.8 | 870 | 250 | × |
| 13 | 350 | 0.63 | 220 | 250 | × |
| 14 | 350 | 0.75 | 260 | 300 | ○ |
| 15 | 350 | 0.94 | 330 | 380 | ○ |
| 16 | 350 | 1.3 | 460 | 500 | ◎ |
| 17 | 350 | 1.9 | 670 | 320 | ○ |
| 18 | 350 | 3.8 | 1330 | 160 | × |
| 19 | 430 | 0.63 | 270 | 310 | ○ |
| 20 | 430 | 0.75 | 320 | 360 | ○ |
| 21 | 430 | 0.94 | 400 | 460 | ◎ |
| 22 | 430 | 1.3 | 560 | 500 | ◎ |
| 23 | 430 | 1.9 | 820 | 260 | × |
| 24 | 430 | 3.8 | 1630 | 130 | × |

DISCHARGE LAMP

TECHNICAL FIELD

The present invention relates to a discharge lamp that contains an emitter in a cathode to improve electron emission, and more particularly to a discharge lamp that contains an emitter other than thorium.

BACKGROUND ART

In general, a cathode of a high luminance discharge lamp that receives a high input or other lamps contains, as an additive, an emitter to facilitate electron emission. For example, Japanese Patent Application Laid-Open Publication No. 2012-15008 (Patent Literature Document 1) discloses a cathode for use in a discharge lamp, which contains a thorium oxide as an emitter.

However, thorium is a radioactive substance, and use of thorium is restricted (regulated) by laws. Thus, handling and managing thorium need careful attentions, and there is a demand for an alternative to thorium.

One of the alternatives to thorium is a rare earth element, another alternative is a compound of rare earth element(s). The rare earth element has a low work function (in general, the work function indicates an energy needed for an electron to jump out of a substance), and is excellent in electron emission. Thus, the rare earth element is expected to be used in place of thorium.

Japanese Patent Application Laid-Open Publication No. 2005-519435 (Patent Literature Document 2) discloses a cathode for use in a discharge lamp, and the material of the cathode (tungsten) additionally contains, as an emitter, lanthanum oxide ($La_2O_3$), hafnium oxide ($HfO_2$), zirconium oxide ($ZrO_2$) or the like.

However, the rare earth oxide such as lanthanum oxide ($La_2O_3$) has a higher vaporization pressure than thorium oxide ($ThO_2$), and is relatively easy to vaporize. Accordingly, if the rare earth oxide is used as the emitter to be contained in the cathode, in place of thorium oxide, then the rare earth oxide excessively vaporizes and is depleted quickly. When the emitter is depleted, the cathode loses the electron emission function. Then, flicker occurs, and the life of the lamp is reduced.

The emitter that contributes to the electron emission is only present at (in) a front end of the cathode. Another reason for the depletion of the emitter is because the emitter is not quickly conveyed to the front end from a rear portion of the cathode. In reality, therefore, the discharge lamp that uses a substance other than thorium oxide as the emitter material still has a problem, i.e., the light emission becomes unstable quickly. In particular, when the discharge lamp is a high-input lamp that receives an electricity of 1 kW or more, then the vaporization of the rare earth element and barium-based substance causes the discharge lamp to emit light in a significantly unstable manner.

Japanese Patent Application Laid-Open Publication No. 2002-141018 (Patent Literature Document 3) discloses a configuration of a cathode that uses an alkaline earth metal (oxide) as the emitter material. FIG. 19 of the accompanying drawings shows the configuration of the cathode. An easy electron emission part 81 is embedded in a cathode 80. An alkaline earth metal oxide is contained, as an emitter, in the easy electron emission part 81. The easy electron emission part 81 is exposed at the front end of the cathode.

Even in this configuration, the alkaline earth metal oxide, which is the emitter, is subjected to an arc. Thus, vaporization of the emitter is further accelerated. This is similar to the electrode disclosed in the above-mentioned Patent Literature Document 2. As a result, similar problems occur. Specifically, the emitter is depleted quickly in particular at the front end of the cathode, and the cathode loses the electron emission function. Then, the flicker is generated. This reduces the life of the lamp.

LISTING OF REFERENCES

Patent Literature Documents

PATENT LITERATURE DOCUMENT 1: Japanese Patent Application Laid-Open Publication No. 2012-15008

PATENT LITERATURE DOCUMENT 2: Japanese Patent Application Laid-Open Publication No. 2005-519435

PATENT LITERATURE DOCUMENT 3: Japanese Patent Application Laid-Open Publication No. 2002-141018

SUMMARY OF THE INVENTION

Problems to be Solved by the Invention

In view of the above-mentioned problems of the conventional technology, the present invention intends to prevent quick (early) depletion of the emitter even if the emitter, other than thorium, is added to the cathode of the discharge lamp. The discharge lamp has a luminous tube, and the cathode and an anode face each other in the luminous tube. The present invention also intends to ensure the electron emission function for a long time, and extend the life of the lamp with regard to the flicker. The present invention further intends to provide a configuration that can emit light smoothly at a start-up and can properly maintain the light emission.

Solution to the Problems

In order to overcome the above-described problems, the present invention provides a discharge lamp that includes a cathode, and the cathode has a main body part and a front end part joined to a front end of the main body part. The main body part is made from a metallic material having a high melting point and containing no thorium. The front end part is made from a metallic material having a high melting point and containing an emitter (except thorium). In a hermetically sealed space (closed space) formed in the main body part and/or the front end part is received a sintered compact that contains an emitter (except thorium) at a higher concentration than the emitter contained in the front end part.

The emitter may be any of lanthanum oxide ($La_2O_3$), cerium oxide ($CeO_2$), gadolinium oxide ($Gd_2O_3$), samarium oxide ($Sm_2O_3$), praseodymium oxide ($Pr_6O_{11}$), neodymium oxide ($Nd_2O_3$) and yttrium oxide ($Y_2O_3$), or a combination thereof.

An emitter concentration (CF) in the front end part may satisfy that 0.5 wt %≤CF≤5 wt %, an emitter concentration (CB) in the sintered compact received in the closed space may satisfy that 10 wt %≤CB≤80 wt %, and CF may be smaller than CB (CF<CB).

A reducing agent may be sealedly disposed in the closed space to reduce the sintered compact and the emitter contained in the sintered compact.

The reducing agent may include any of titanium (Ti), tantalum (Ta), vanadium (V) and niobium (Nb).

The front end part may be made from tungsten. The emitter contained in the sintered compact may be cerium oxide. The distance between a front end of the cathode and a front end of the sintered compact may be 1.5 mm to 3.5 mm.

The front end part of the cathode may have a truncated cone shape, and a following equation may be established:

$$165 \geq I/S \text{ (A/mm}^2\text{)}$$

where S represents a cross section of the cathode at a position of 0.5 mm from a front end of the cathode and has a unit of $mm^2$, and I represents a lamp current and has a unit of A (ampere).

The sintered compact may contain a rare earth complex (compound) oxide.

The rare earth complex (compound) oxide may contain an oxide that includes oxygen and an element selected from Groups 4A, 5A and 6A in the periodic table.

The rare earth complex oxide may be a compound of a metal having a high melting point and any of lanthanum oxide ($La_2O_3$), cerium oxide ($CeO_2$), gadolinium oxide ($Gd_2O_3$), samarium oxide ($Sm_2O_3$), praseodymium oxide ($Pr_6O_{11}$), neodymium oxide ($Nd_2O_3$) and yttrium oxide ($Y_2O_3$).

A specific resistance ρ of the front end part may be 0.65 to 0.77 μΩcm when a measuring temperature T is 77 K.

The front end part may be made from tungsten. The front end part may contain a grain stabilizing agent (zirconium oxide or hafnium oxide) to restrict or regulate crystal growth (grain growth) of tungsten.

The main body part and/or the front end part may include a fibrous metallographic structure formed in an area around the sintered compact, and the fibrous metallographic structure may extends in an axial direction of the cathode.

A front end face of the sintered compact may contact the front end part in the closed space, and the fibrous metallographic structure may be formed in a 5 mm backward region from the front end face of the sintered body.

The front end part may be made from tungsten, and a rhenium-tungsten alloy part may be formed at that end face of the front end part which faces the anode.

The thickness of the rhenium-tungsten alloy part may be equal to or greater than 0.5 mm.

The front end part may be made from tungsten, and a product (A×B) of a grain boundary density A ($mm^{-1}$) of tungsten in the front end part and a concentration gradient B ($mol/mm^4$) of the first emitter from that point of the front end part which contacts the sintered compact, to the front end face may satisfy a following equation:

$$260\times10^{-9} \text{ (mol/mm}^5\text{)} \leq A\times B \leq 670\times10^{-9} \text{ (mol/mm}^5\text{)}.$$

Advantageous Effects of the Invention

In this invention, the front end part is joined to the front end of the main body part. The front end part contains the emitter other than thorium, and the main body part does not contain thorium. The sintered compact is received or embedded in the closed space formed in the main body part and/or the front end part. Because the emitter (other than thorium) contained in the sintered compact has a greater concentration than the emitter contained in the front end part, the emitter contained in the front end part (other than thorium) covers the front end part when the discharge lamp is firstly lit. This ensures good start-up operation of the discharge lamp, and good light emission.

The emitter contained in the front end part is consumed as the lighting time passes. However, the high concentration emitter contained in the sintered compact, which is provided in the cathode, supplies the emitter toward the front end part as the emitter diffuses toward the front end part. Consequently, the emitter is not depleted at the front end part, and the good light emission is maintained in a stable manner for a long time.

The sintered compact is received or embedded in the cathode. Thus, the sintered compact is not directly exposed to the discharge arc, and the sintered compact is not likely to be excessively heated by the arc. As a result, the emitter does not vaporize excessively, and the emitter is not depleted at an early stage.

When the lamp is turned off (or unlit) after a certain time of light emission, and the cathode is cooled, then the emitter stays at (in) the front end part because the emitter diffuses toward the front end part from the sintered compact during the light emission. Thus, when the discharge lamp is turned on again, the emitter in the front end part facilitates the start-up of the discharge lamp and ensures the good light emission of the discharge lamp.

The emitter contained in the sintered compact, which is provided in the cathode, diffuses along the crystal grain boundary of tungsten that forms the front end part (grain boundary diffusion), thereby proceeding to the front end of the cathode. If cerium is used as the emitter, this diffusion takes place quickly (fast), and the emitter is supplied to the front end of the cathode at a sufficient speed.

In addition, the emitter is usually contained in the sintered compact in the form of oxide ($CeO_2$ if the emitter is cerium). Because $CeO_2$ has low moisture absorbing capability, there is an advantage that an amount of moisture trapped in the lamp during the lamp manufacturing process is reduced.

If the front end part of the cathode has a truncated cone shape, and a following equation is established: $165 \geq I/S$ ($A/mm^2$), where S represents a cross sectional area of the cathode at a position of 0.5 mm from a front end of the truncated cone of the cathode, and I represents a lamp current, then it is possible to obtain a high current density and allow the lamp to emit light at high luminance.

If the sintered compact contains the rare earth complex oxide therein, the sintered compact is reduced to the state of the emitter (metal) at a temperature lower than when the sintered compact is made from an ordinary oxide. Accordingly, the feeding of the emitter from the sintered compact takes place smoothly even when the electrode temperature is low, i.e., even during the start-up operation of the lamp. Thus, shortage of the emitter does not occur even from the start of light emission, and the stable light emission is realized.

If the specific resistance ρ of the front end part is set to 0.65 to 0.77 μΩcm, then it is possible to extend the life of the lamp with regard to the flicker.

If the fibrous metallographic structure is formed in an area around the sintered compact, and the fibrous metallographic structure extends in the axial direction of the cathode, then the emitter (rare earth element) contained in the sintered compact is difficult to diffuse in a radial direction of the cathode, and therefore the emitter is forced to diffuse toward the front end. Thus, the feeding of the emitter to the front end of the cathode takes place smooth and quickly. As a result, the depletion of the emitter at the front end part is avoided. Also, the vaporization of the emitter from that side face of the cathode which is not exposed to the arc is suppressed, and the devitrification (clouding, or loss of clarity) of the luminous tube is prevented.

When the front end part is heated to an extremely high temperature by the arc, recrystallization of the crystal grains may proceed and the grain boundary may disappear. However, if the rhenium-tungsten alloy part is disposed on that front end face of the front end part which faces the anode, the recrystallization is suppressed at the rhenium-tungsten alloy part even at a high temperature because the rhenium-tungsten alloy part has a higher recrystallization temperature than ordinary tungsten. Thus, the crystal grain boundary is maintained, and the grain boundary diffusion of the emitter from the sintered compact is not blocked.

The product (A×B) of the grain boundary density A ($mm^{-1}$) of tungsten in the front end part and a concentration gradient B ($mol/mm^4$) of the emitter from that point of the front end part which contacts the sintered compact, to the front end face satisfies the following equation:

$$260\times10^{-9}\ (mol/mm^5)\leq A\times B\leq 670\times10^{-9}\ (mol/mm^5)$$

Therefore, the emitter is supplied in a stable manner for a long time, and the discharge lamp can have a long life.

BRIEF DESCRIPTION OF THE DRAWINGS

FIG. 2(A) shows an exemplary configuration of the cathode in the first embodiment of the present invention.

FIG. 2(B) shows another exemplary configuration of the cathode in the first embodiment.

FIG. 2(C) shows still another exemplary configuration of the cathode in the first embodiment.

FIG. 3(A) to FIG. 3(D) are a set of views useful to describe a method of manufacturing the cathode according to the first embodiment of the present invention.

FIG. 5 is Table 1 that shows experimental results in a second embodiment of the present invention.

FIG. 6 is Table 3 that shows experimental results in a third embodiment of the present invention.

FIG. 8 is Table 4 that shows melting points of exemplary rare earth oxides in a fourth embodiment of the present invention.

FIG. 10 is Table 5 that shows tendency of the lamp life in accordance with a specific resistance of the front end part.

FIG. 17 is Table 8 that shows experimental results of the eighth embodiment of the present invention.

DETAILED DESCRIPTION OF EMBODIMENTS

Figure 1:
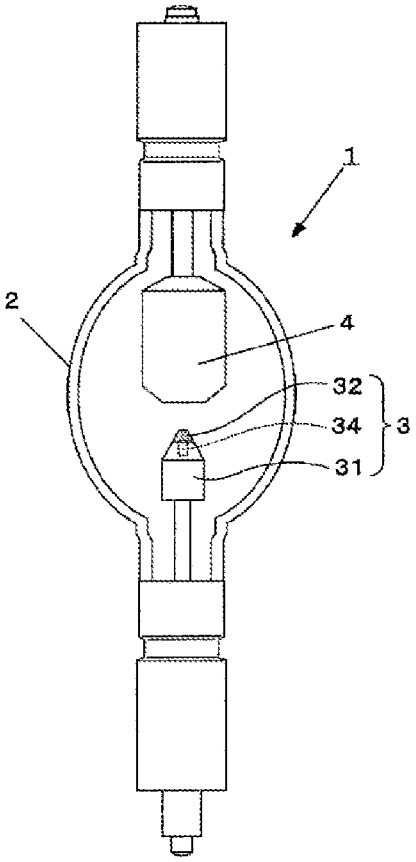
FIG. 1 shows an overall view of a discharge lamp that has a cathode configuration according to a first embodiment of the present invention.

FIG. 1 illustrates an entire structure of a discharge lamp having a cathode according to an embodiment of the present invention. The discharge lamp 1 includes a luminous tube (arc tube) 2, and a cathode 3 and an anode 4 are arranged in the luminous tube 2 such that the cathode 3 and the anode 4 face each other.

As shown in FIGS. 2(A)-2(C), the cathode 3 has a main body part 31 and a front end part 32 joined to a front end of the main body part in the first embodiment.

The main body part 31 is made from a metallic material having a high melting point such as tungsten or molybdenum. The main body part 31 does not contain thorium.

The front end part 32 is joined to the front end of the main body part 31. In other words, the front end part 32 is joined to that face of the main body part 31 which faces the anode 4, by an appropriate joint such as a solid phase joint, welding or the like. The front end part 32 contains an appropriate amount of emitter other than thorium (hereinafter, the emitter contained in the front end part may be referred to as "first emitter.").

The first emitter, which does not include thorium, is, for example, any of lanthanum oxide ($La_2O_3$), cerium oxide ($CeO_2$), gadolinium oxide ($Gd_2O_3$), samarium oxide ($Sm_2O_3$), praseodymium oxide ($Pr_6O_{11}$), neodymium oxide ($Nd_2O_3$) and yttrium oxide ($Y_2O_3$), or a combination thereof.

An amount of the first emitter contained is set to a low value, e.g., from 0.5 weight % to 5.0 weight %. The first emitter serves to ensure smooth light emission at an initial start-up of the lamp. The concentration is set to a low value in order to prevent the emitter from excessively vaporizing as the emitter is subjected (exposed) to the discharge arc.

If the content of the first emitter is less than 0.5 weight %, a sufficient amount (concentration) of emitter to release the electrons is not ensured upon turning on of the lamp (start-up of the lamp). Thus, the lamp voltage increases and/or fluctuates considerably. If the content of the first emitter is greater than 5.0 weight %, a sintered compact becomes fragile when it is prepared with a tungsten material or the like. Thus, breakage is likely to occur due to cracking during a sintering process and/or a swaging process. In addition, even if a sintered compact is manufactured, the first emitter vaporizes significantly when the first emitter is used as the front end part. This may facilitate blackening of a bulb, i.e., the bulb becomes clouded. This is not preferred.

As shown in FIGS. 2(A) to 2(C), a closed space (hermetically sealed space) 33 is formed in the cathode 3. A sintered compact 34 is received in the closed space 33. The emitter, other than thorium, is contained in the sintered compact 34.

In FIG. 2(A), the closed space 33 is formed in the main body part 31. The sintered compact 34 is substantially received or embedded in the main body part 31.

In FIG. 2(B), the closed space 33 is formed such that the closed space 33 spans the main body part 31 and the front end part 32. The sintered compact 34 is received in the main body part 31 and in the front end part 32.

In FIG. 2(C), the closed space 33 is formed in the front end part 32. The sintered compact 34 is substantially received or embedded in the front end part 32.

It goes without saying that the size of the front end part 32, in particular the thickness of the front end part 32, varies depending upon which one of the three examples is used. Which one of the three examples is selected is appropriately decided in accordance with easiness of the manufacturing, a cost that depends upon the thickness of the front end part 32, and an overall cost of manufacturing the entire cathode.

In any of the three examples, it is preferred that the distance between the front end of the sintered compact 34 and the front end of the cathode 3 be from 1.5 mm to 5.0 mm.

The sintered compact 34 contains an emitter, other than thorium. Hereinafter, the emitter contained in the sintered compact 34 may be referred to as "second emitter." For example, similar to the emitter contained in the front end part 32, the second emitter includes a constituent material (main component) such as tungsten, and an additive such as lanthanum oxide, cerium oxide, gadolinium oxide, samarium oxide, praseodymium oxide, neodymium oxide, or yttrium oxide, or a combination of these oxides. The main component and the additive are sintered.

The concentration of the second emitter contained in the sintered compact 34 is set to a value higher than the concentration of the first emitter contained in the front end part 32. For example, the concentration (weight %) of the second emitter is 10 weight % to 80 weight %.

If the concentration of the second emitter is smaller than 10 weight %, it is difficult to ensure a sufficient amount of emitter to be supplied to the front end part 32 of the cathode due to the size of the sintered compact 34 received in the cathode 3. If the concentration of the second emitter is greater than 80 weight %, the percentage of the constituent material of the sintered compact 34 such as tungsten decreases, and a product made upon reduction of the oxide decreases. In either case, the life of the cathode is reduced.

Because the second emitter contained in the sintered compact 34 is received (embedded) in the cathode 3, the second emitter is not directly exposed to the discharge arc, and is not heated more than necessary. Thus, the second emitter does not vaporize excessively. The sintered compact 34 is appropriately heated upon turning on (light emission) of the lamp. Then, the second emitter in the sintered compact 34 is supplied to the front end part 32 as the concentration diffusion of the second emitter takes place. Accordingly, the emitter does not run out (disappear) at the front end part 32, and stable light emission continues.

Preferably, that end face of the sintered compact 34 which is closer to the front end of the cathode is in contact with the front end part 32. This causes the second emitter contained in the sintered compact 34 to abut against (contact) the front end part 32 while the lamp is emitting light. Then, the emitter diffuses along the grain boundary, and moves to the front end part 32 smoothly and quickly. Thus, the second emitter is reliably supplied to the front end part 32.

It should be noted that the first emitter may be made from the same material as the second emitter, or made from a different material from the second emitter. For example, the first emitter and the second emitter may be made from the same material such as lanthanum oxide. Alternatively, the first emitter may be made from a combination of lanthanum oxide and zirconium oxide, and the second emitter may be made from a different material (may be made from cerium oxide). Combinations of the materials may be arbitrary.

Now, the roles and functions of the front end part 32 and the sintered compact 34 of the cathode 3 in this embodiment will be described. The front end part 32 has a diffusion path that carries (conveys) the emitter to the front end face, from which electrons are released. When the lamp is turned on, the first emitter contained in the front end part 32 is conveyed to the front end face and the electrons are released. Thus, light emission takes place reliably in a start-up period. Because of this light emission, the first emitter originally contained in the front end part 32 is consumed. Before the first emitter is depleted, the second emitter in the sintered compact 34 embedded in the cathode 3 moves through the diffusion path of the front end part 32 and arrives at the front end face. In this manner, the emitter is not depleted at the front end face.

As described above, the main body part 31 is made from a metal having a high melting point such as tungsten and having no thorium. This does not exclude a possibility that the main body part 31 may contain an emitter except thorium. If the main body part contains an emitter other than thorium, a different advantage arises. Because the sintered compact 34 has a high concentration of emitter, the emitter contained in the main body part 31 does not demonstrate a significant advantage in terms of supplying the emitter to the front end part 32. However, the main body part 31 and the front end part 32 are made from the same material, and therefore the main body part and the front end part have the same thermal property even after they are joined. If the main body part 31 and the front end part 32 are exposed to a high temperature during the light emission of the lamp, the connection between the main body part 31 and the front end part 32 is less likely to be damaged because the main body part 31 and the front end part 32 have the same thermal property as a one-piece structure.

An exemplary size of the cathode structure of this embodiment is shown below.

Cathode outer diameter: 15 mm

Cathode length in axial direction: 60 mm

Front end part length in axial direction: 2 mm

Front end part material: lanthanum oxide (emitter), tungsten doped with zirconium oxide (agent for suppressing the coarsening of tungsten particles)

Main body part length in axial direction: 58 mm

Main body part material: tungsten doped with zirconium oxide

Sintered compact diameter: 2 mm

Sintered compact length in axial direction: 5 mm

Sintered compact material: mixture of cerium oxide and tungsten at the weight ratio of 1 to 2. This mixture is molded and sintered.

Now, a method of manufacturing the cathode of the embodiment of the invention will be described with reference to FIGS. 3(A) to 3(D).

The sintered compact 34 embedded in the closed space 33 inside the cathode 3 is a mixture of the emitter ($CeO_2$) and tungsten (W) at the mixing ratio of 1:2. A binder (stearic acid) is added to this mixture, and molded by a press machine. Subsequently, the mixture undergoes a grease-removing process and a preliminary sintering process in hydrogen at a temperature of 1000 degrees C. The mixture then undergoes the sintering process in vacuum in a tungsten furnace at a temperature of 1700 to 2000 degrees C., preferably at a temperature of 1800 to 1900 degrees C., for one hour, thereby obtaining the cathode.

The front end part 32 of the cathode is made from $La_2O_3$ and $ZrO_2$-doped tungsten. The main body part 31 is made from $ZrO_2$-doped tungsten. Both of the front end part 32 and the main body part 31 are sintered in vacuum at the temperature of 2300 to 2500 degrees C. When the tungsten, which contains the emitter, is sintered at a higher temperature (e.g., 3000 degrees C.), the emitter vaporizes and disappears. This is not desirable.

If the main body part 31 does not contain an emitter, the sintering may be carried out at an even higher temperature, such as 2700 to 3000 degrees C.

Referring first to FIG. 3(A), a hole 33*a* is formed in the front end of a main body material (blank) 31*a*, which will eventually become the main body part 31. The hole 33*a* will eventually become the closed space 33. The sintered compact 34 is placed into the hole 33*a*. Then, a front end member (blank) 32*a*, which will eventually become the front end part 32, is caused to abut against the sintered compact 34.

In this situation, as shown in FIG. 3(B), the front end (upper end) of the sintered compact 34 protrudes from the upper surface of the main body part 31 by a small amount (approximately 0.5 mm).

As illustrated in FIG. 3(C), the front end member 32*a* is pushed to compress the sintered compact 34 such that the front end member 32*a* abuts against the main body member 31*a*. Because the sintered compact 34 is sintered at a temperature lower than the sintering temperature of the main body part 31 and the sintering temperature of the front end part 32, an amount of shrinkage of the sintered compact 34 upon being compressed is large. As the front end member 32*a* abuts against the main body member 31*a*, the sintered compact 34 shrinks by a small amount such that the sintered compact 34 abuts against the front end member 32*a*.

In this situation, the front end member 32*a* is joined to the main body member 31*a* by diffusion bonding, spot welding or the like.

After the front end member 32*a* is joined to the main body member 31*a*, a front portion of the cathode 3 undergoes a cutting or machining process.

As a result, the cathode 3 having the ultimate shape is obtained, as shown in FIG. 3(D). Specifically, the front end part 32 is joined to the front end (upper end) of the main body part 31, and the sintered compact 34 is sealedly embedded in the closed space 33 inside the cathode 3.

Figure 4A:
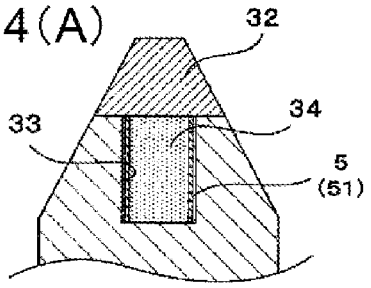
FIG. 4(A) shows one modification to the cathode configuration of the first embodiment of the present invention.
Figure 4B:
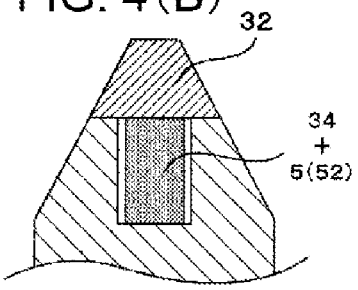
FIG. 4(B) shows another modification to the cathode configuration of the first embodiment.
Figure 4C:
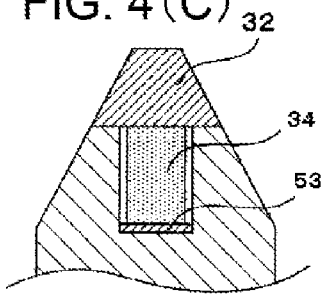
FIG. 4(C) shows still another modification to the cathode configuration of the first embodiment.

FIGS. 4(A) to 4(C) show a plurality of examples, which can be obtained in accordance with the first embodiment. In each of these examples, the sintered compact 34 and a reducing agent 5 are sealedly disposed in the closed space 33. The reducing agent 5 facilitates a reducing reaction of the emitter.

FIG. 4(A) shows when a foil 51 of the reducing agent is wound around the sintered compact 34, and the sintered compact 34 is received in the closed space 33 together with the foil 51 in a sealed manner. Specifically, a Ta foil, which has a thickness of 5-40 μm, is wound around the sintered compact 34.

FIG. 4(B) shows when a powder of the reducing agent is added to the sintered compact 34. For example, a Ta powder, which is 1-10 μm in grain diameter, is added to the sintered compact 34. A tungsten powder, which is a constituent material of the sintered body, is mixed with the Ta powder, and this mixture is sintered.

FIG. 4(C) shows when a reducing agent powder 53 such as a Ta powder is placed under the sintered compact 34 in the closed space 33.

It should be noted that how the reducing agent is sealedly placed in the closed space is not limited to the above-described examples. For example, a paste of the reducing agent may be applied to an outer circumferential surface of the sintered compact 34.

The reducing agent used in this embodiment is preferably any of titanium (Ti), tantalum (Ta), vanadium (V) and niobium (Nb). An amount of the reducing agent to be sealedly placed is 1 wt % to 30 wt % relative to a total amount of the second emitter contained in the sintered compact 34.

It should be noted that carbon (C) may be used as the reducing agent. Carbon may react with tungsten oxide, which is produced upon a reaction of the emitter with tungsten (W), and produce CO. Then, CO may diffuse from the sintered compact 34 and reach the front end part 32. CO may be decomposed into C and O, and become a solution. The solution may diffuse to the front end face of the cathode. Ultimately, the solution may become $O_2$ and CO and be released into the discharge vessel. As $O_2$ and CO arrive at the anode, tungsten oxide and tungsten carbide may be produced, and cause the blackening of the discharge vessel and a deformation of the anode. Accordingly, carbon (C) is not a desirable substance.

Thus, it is preferred that Ti, Ta, V, Nb or the like is used as the reducing agent, rather than carbon (C).

In FIG. 1, the cathode structure of this embodiment of the invention is applied to a short arc discharge lamp such as a mercury lamp or a xenon lamp. It should be noted, however, that the cathode structure of this embodiment of the invention may be applied to a long arc discharge lamp.

As described above, the first emitter other than thorium is added to the cathode, and the discharge lamp includes such cathode in this embodiment. Also, the first emitter is contained in the front end part that is joined to the main body part. Therefore, the emitter ensures the good light emission at the start-up of the lamp, and reliable light emission is carried out.

The sintered compact embedded and sealedly disposed in the cathode contains the second emitter that has a higher concentration than the first emitter in the front end part. Thus, the second emitter diffuses as the lamp continues to emit light. The second emitter diffuses and moves toward the front end part such that the second emitter is supplied to the front end part. Accordingly, the shortage of the emitter at the front end part does not occur. The emitter is continuously supplied to ensure stable light emission of the lamp.

Because the sintered compact is embedded (received) and sealed in the cathode, and is not directly exposed to the discharge arc, the emitter having a high vapor pressure other than thorium does not vaporize excessively, and does not run out (disappear) in a short time.

Further, because the reducing agent is sealed in the closed space, the reducing reaction of the emitter is facilitated, and the feeding of the emitter to the front end part does not delay.

In the above-described first embodiment, the sintered compact 34 contains, as an exemplary emitter, the rare earth oxide such as lanthanum oxide ($La_2O_3$), cerium oxide ($CeO_2$) and gadolinium oxide ($Gd_2O_3$). Out of these substances, cerium is expected to have the highest diffusion speed. Cerium is relatively inexpensive among the expensive rare earth elements, and easy to obtain. In the following description, a second embodiment will be described when cerium is contained as the emitter.

In the second embodiment, the cathode shown in FIG. 2 includes the sintered compact 34 and the emitter, which is contained in the sintered compact 34. The emitter is cerium oxide, and the concentration (weight %) of cerium oxide is higher than the concentration (weight %) of the emitter contained in the front end part 32.

Preferably, the distance between the front end of the cathode 3 and the front end of the sintered compact 34 is from 1.5 mm to 3.5 mm.

The emitter contained in the front end part 32 may be any of lanthanum oxide ($La_2O_3$), cerium oxide ($CeO_2$), gadolinium oxide ($Gd_2O_3$), samarium oxide ($Sm_2O_3$), praseodymium oxide ($Pr_6O_{11}$), neodymium oxide ($Nd_2O_3$) and yttrium oxide ($Y_2O_3$), or a combination of these oxides.

The emitter concentration (CF) of the front end part 32 satisfies the condition of 0.5 wt %≤CF≤5 wt %. The emitter concentration (CB), i.e., cerium oxide concentration, of the sintered compact 34 embedded in the closed space 33 satisfies the condition of 10 wt %≤CB≤80 wt % in terms of cerium oxide.

The emitter in the sintered compact 34 is expected to diffuse along the crystal grain boundary of tungsten, which forms the front end part 32, and arrive at the front end of the cathode. This diffusion is referred to as grain boundary diffusion.

When cerium is contained in the sintered compact 34, this diffusion proceeds fast. Thus, a sufficient feeding speed is obtained in terms of the feeding speed of the emitter to the front end of the cathode. Also, there is another advantage. The emitter is usually contained in the sintered compact in the form of oxide, but the moisture absorbing capability of cerium oxide ($CeO_2$) or the oxide of cerium is low, and therefore it is possible to reduce an amount of moisture to be trapped in the lamp during the lamp manufacturing process.

The movement mechanism in the cathode will be described. The sintered compact usually contains cerium in the form of cerium oxide ($CeO_2$). When the temperature of the sintered compact becomes high while the lamp is emitting light, then a reducing reaction takes place in the sintered compact, and cerium (Ce) is produced from cerium oxide. The resulting cerium is conveyed to the front end face of the cathode through the front end part by the grain boundary diffusion. Cerium forms a monoatomic layer on the surface of tungsten at the front end of the cathode such that cerium functions as the emitter. The monoatomic layer of cerium leaves the surface of tungsten at a speed corresponding to the temperature of cerium because the temperature of cerium is high. If the conveying speed of cerium to the front end face of the cathode is high, and a multi-atomic layer of cerium is formed at the front end face of the cathode, then the separation (leaving) of cerium from the front end of the cathode increases because the separation energy of cerium from the cerium surface is smaller than the separation energy from the tungsten surface. The leaving cerium then adheres to the inner surface of the luminous tube of the lamp, and creates the clouding. On the other hand, if the conveying speed of cerium to the front end face of the cathode is slow, the emitter (cerium) is depleted at the front end face of the cathode.

The above-described grain boundary diffusion of cerium can be expressed by the equation (1) where the distance from the front end of the cathode in the axial direction is represented by x.

$$\text{Diffusion Speed (Amount of Ce passing per unit time)} = -D(T)\frac{dn}{dx} \quad \text{Equation (1)}$$

$$\text{Grain Boundary Diffusion Coefficient of } Ce\text{: } D(T) = D_o e^{-(Q/RT)} \quad \text{Equation (2)}$$

where n represents the Ce concentration at the front end part, Do represents a constant, Q represents activation energy of diffusion, R represents a gas constant, and T represents a temperature (degrees K). It is understood from the equations (1) and (2) that the conveying speed of cerium in the grain boundary diffusion becomes higher as the concentration gradient dn/dx of Ce becomes greater. The conveying speed of cerium in the grain boundary diffusion also becomes higher as the temperature rises.

In view of these facts, the sintered compact is embedded or buried in the cathode such that the front end of the sintered compact is present at a position between 1.5 mm and 3.5 mm from the front end of the cathode. In other words, if the front end of the sintered compact is situated at a position between 0 mm and 1.5 mm from the front end of the cathode, the concentration gradient of cerium along the path of the grain boundary diffusion of cerium (that portion of the front end part which is present forward of the sintered compact) becomes large. Also, the average temperature along the path of the grain boundary diffusion of cerium becomes high. Thus, the conveying speed of cerium increases, the cerium leaving from the front end of the cathode increases, and the clouding of the luminous tube occurs. On the other hand, if the sintered compact is embedded in the cathode such that the front end of the sintered compact is present at a position more than 3.5 mm backward of the front end of the cathode, then the conveying speed of cerium decreases for the opposite reasons, and the emitter (cerium) is depleted at the front end face of the cathode.

It should be noted that the action temperature of the front end face of the cathode varies with the lamp input, the current, the cathode shape, the emitter type, the mother material of the front end part, and other factors. Thus, the leaving speed of cerium from the front end face of the cathode also varies with these factors. However, because the temperature of the cathode front end is linked with the temperature of the path of the grain boundary diffusion of cerium (that portion of the front end part which is present forward of the sintered compact), the embedding position of the sintered compact does not depend on the temperature of the front end face of the cathode very much for the purpose of balancing between the leaving of cerium from the cathode front end and the feeding of cerium to the cathode front end. For example, when two cathodes are compared to each other, with the current and/or the diameter of the cathode front end being different, and therefore the current density at the cathode front end (i.e., value obtained by dividing the current by an area of the front end face) being different, a cathode having a greater current density has a higher temperature at the cathode front end, and has a faster emitter leaving speed. However, the temperature in the front end part, which is the Ce diffusion path, becomes also high. Accordingly, the Ce diffusion coefficient becomes larger in accordance with the equation (2), and the Ce feeding speed to the cathode front end becomes faster. As a result, the embedding position of the sintered compact can be the substantially the same in these two cathodes.

Experiments were carried out with a lamp that had the following specifications. A cathode of the lamp included a sintered compact and an emitter, which was contained in the sintered compact. Cerium was used as the emitter.

Experiments

The front end part of the cathode: $La_2O_3$ (2 weight %) and $ZrO_2$ (0.05 weight %) were added to tungsten. Density was 18.4 g/cm$^3$. Length was 2 mm.

The main body part of the cathode: $ZrO_2$ (0.8 weight %) was added to tungsten. Density was 18.5 g/cm$^3$. Length was 17 mm.

The sintered compact: $CeO_2$:W=1:2 (weight ratio). $CeO_2$ (33 weight %). Density was 9.5 g/cm$^3$. Diameter (ϕ) was 1.4 mm. Length (L) was 6 mm.

The shape of the cathode: Front end diameter (ϕ) was 0.9 mm. Tapered angle was 55 degrees. Cathode diameter (ϕ) was 12 mm. Total length was 21 mm.

The lamp: 7 kW. Xe short arc lamp (designed as a light source for a digital projector).

Electrical characteristics: 175 A, 40 V, 7 kW

The experiments were carried out with the above-described lamp while the embedding position of the sintered compact (i.e., the distance (L) from the front end of the cathode to the front end of the sintered compact) was changed.

Results of the experiments are indicated in Table 1, which is shown FIG. 5.

(1) The illuminance preserving factor is a preserving factor of an average illuminance that is obtained when the light from the lamp is condensed by a predetermined oval mirror, and a prescribed rectangular area is irradiated with the light (ratio of illuminance of after 500-hour lighting to an initial illuminance).

(2) The voltage variation is a voltage fluctuation width, which is read from a chart prepared after the lamp voltage is measured by a prescribed analog pen recorder for twenty minutes. The chart speed was 120 mm/h and the voltage range was 30 to 50 V. The voltage variation is an alternative characteristic of arc stability (flicker). Specifically, the fluctuation width of the lamp voltage measure by this method has a correlation with the illuminance variation that appears in an image on the digital projector. It is confirmed that when the fluctuation width of the lamp voltage exceeds 1.2 V, the flicker of the image is perceived by human eyes. The inventors assume that this is because the frequency characteristics (response speed) of the pen recorder have approximation to the sensitiveness characteristics (sensitivity behavior) of human eyesight with regard to the flicker stimulation light.

The life of a conventional 7 kW Xe short arc lamp, which has a thoritung (thoriated tungsten) cathode, is defined by the lighting time (operating time) of the lamp till the lamp becomes disable to emit light (including rupture of the lamp) or till the flicker occurs. The average life of the conventional 7 kW Xe short arc lamp is 500 hours. One of the most common phenomena that decide the life of the lamp with regard to capability of lighting is the rupture. As to the rupture, it is known that if clouding or blackening of the luminous tube progresses to approximately 50% in terms of the illuminance preserving factor, the light from the arc is more absorbed and the temperature of the luminous tube rises. Accordingly, thermal strain or distortion is accumulated in the luminous tube, and probability of the rupture increases. In the meantime, the generation of the flicker can be detected from the fluctuation width of the lamp voltage as mentioned in the (2).

Thus, the quality (good or bad) of the cathode of the lamp was examined on the basis of the illuminance preserving factor and the voltage variation after the lamp was lit 500 hours. Specifically, when the voltage fluctuation width after 500-hour lighting is no greater than 1.2 V and the illuminance preserving factor is no smaller than 50%, then the cathode quality is determined to be good (the cathode is determined to have a similar longevity to a common thoritung cathode).

As a result of the examination, it was found that the good results were obtained when the distance (L) between the front end of the cathode 3 and the front end of the sintered compact 34 was in a range from 1.5 mm to 3.5 mm.

It should be noted that the sintered compact 34 contained cerium in the form of cerium oxide in the above-described experiments, but the sintered compact 34 may contain cerium in the form of a cerium metal.

A third embodiment will be described below. In the third embodiment, the current density at the front end of the cathode of the first embodiment is defined.

Specifically, the cathode structure shown in FIG. 2 is used, with the front end part of the cathode having a substantially truncated cone shape. When the cross sectional area of the front end part at a position 0.5 mm from the front end is represented by S (mm$^2$) and the lamp current is represented by I (A), then the relation of $165 \geq I/S$ (A/mm$^2$) is established.

With such condition, a high current density is obtained, and the lamp can emit light at high luminance. Thus, a discharge lamp having a thoria-free (thorium-free) cathode is obtained. The obtained discharge lamp includes an emitter other than thorium.

The definition of the current density in the present invention will be described below.

Firstly, the emitter and a work function will be described.

Usually, the emitter is evaluated to be good when a high current density (current value per unit area) is obtained even at a low operating temperature. The current density in relation to the operating temperature is formulated by Richardson-Dushman. This is known as a Richardson-Dushman equation.

Specifically, the current density J follows the equation:

$$J=A^*T^2\exp\{-(\phi-\Delta\phi/(kT)\}$$

where T represents the temperature, A represents an electron emission coefficient which is specific (unique) to the material, ϕ represents a work function which is specific to the material, k represents a Boltzmann constant, and Δϕ is a decreased amount which is subtracted, in effect, from the work function due to the Schottky effect.

It is understood from this equation that the work function ϕ of the material is preferably small and the coefficient A of the material is preferably large in consideration of the operating temperature if the electron emission capability is set to obtain a high current density. It is desired that the material of the emitter of the cathode can cause the cathode to function properly at a low temperature if the deformation and abrasion of the cathode front end should be reduced or avoided.

The cathode of the short arc discharge lamp operates at a high temperature (around 3000 degrees K). Thus, the deformation of the cathode and the vaporization from the cathode are inevitable. The substances generated upon the vaporization adhere to the bulb, and cause the blackening and/or clouding.

In order to suppress or reduce the vaporization, the emitter needs to be modified such that the cathode main part avoids generation of a compound having a low melting point or generates such compound to the minimum. Alternatively, it is desired that the material of the emitter has a slow vaporization speed and a low vaporization pressure.

As an example, the following description deals with thorium and cerium, and compares the electron emission capability. The calculated values of the work function, the coefficient and the current density are indicated in Table 2. As to the coefficient A in Table 2, K represents the temperature.

TABLE 2

| Material Name | Work Function $\phi$ (eV) | Coefficient A ($A/cm^2/K^2$) | Current Density J (T = 3400 K, $\Delta\phi$ = 0.3 eV) ($A/mm^2$) |
|---|---|---|---|
| W—Ce | 2.7 | 8 | $J_{Ce} = 2.56 \times 10^2$ |
| W—Th | 2.7 | 4 | $J_{Th} = 1.28 \times 10^2$ |

It is understood from Table 2 that the coefficient A of cerium tungsten (hereinafter, referred to as "ceri-tun") is twice as much as the coefficient A of thoriated tungsten (hereinafter, referred to as "thori-tun"). If cerium tungsten operates at the same temperature (3400 degrees K) as thoriated tungsten, cerium tungsten can provide a current density twice as much as thoriated tungsten.

In reality, however, it is not preferred that the oxide material of cerium tungsten and the oxide material of thoriated tungsten be used at a temperature over its melting point because the vaporization speed of the emitter becomes very fast. In the simulation, the inventors assume that use of the oxide material is acceptable up to the vicinity of the melting point of that oxide material, and make the comparison.

The melting point of thorium oxide ($T_{ThO2}$) is 3573 degrees K, and the melting point of cerium oxide ($T_{CeO2}$) is between 2873 and 3000 degrees K. Assuming that thorium oxide can be used until near its melting point and cerium oxide can be used until near its melting point, the current density $J_{Th}$ is $1.28\times10^2$ ($A/mm^2$) if $T_{ThO2}$ is 3400 degrees K whereas the current density $J_{Ce}$ is $0.454\times10^2$ ($A/mm^2$) if cerium oxide is used at a temperature $T_{CeO2}$ being 2900 degrees K. It is obvious from the foregoing that thorium tungsten is better in the electron emission capability. However, use of thorium is becoming difficult for the reasons which are mentioned earlier.

In recent years, a xenon lamp is used as a light source for a digital cinema in a movie theater, a mercury lamp or the like is used as a light source for exposing a semiconductor and a liquid crystal, and a common short arc discharge lamp that uses the xenon lamp, the mercury lamp or the like is expected to have a cathode that has a high current density in order to obtain a light source having a high luminance.

It is a general tendency that the cathode needs to operate at a high temperature in order for the lamp to operate at a high current density.

As mentioned above, however, if tungsten, which contains the emitter other than thorium, is exposed at the most front portion of the cathode, the emitter is depleted soon. In this invention, therefore, the front end part that contains the emitter at a low concentration, other than thorium, is joined to the main body part of the cathode, and the sintered compact that contains the emitter at a high concentration is embedded in the front end part and/or the main body part of the cathode. Accordingly, the cathode does not expose the sintered compact containing the high concentration of emitter, at the most front portion of the cathode.

Experiments were carried out to obtain an appropriate current density for the discharge lamp having such cathode structure. The discharge lamp had the following specifications.

The overall configuration of the discharge lamp was the same as that shown in FIG. 1. The diameter of quartz glass bulb was 80 mm. The bulb had a generally spherical shape. An anode and a cathode were disposed in the bulb such that the anode faced the cathode. The distance between the anode and the cathode was 6 mm, and the pressure of the xenon gas sealed in the bulb was 10 atmospheric pressure.

The anode was made from tungsten, and had a cylindrical shape with its diameter $\phi$ being 15 mm and its length L being 20 mm. The diameter of the front end face of the anode, which faced the cathode, was 5 mm.

The cathode had the same shape as that shown in FIG. 2(A). The front end face of the front end part of the cathode had a generally circular shape, and the cone angle from the front end toward the lower part thereof was 40 degrees.

The front end part of the cathode was made from cerium tungsten that contained the emitter by two weight %. The thickness was 2 mm.

The main body part of the cathode was made from pure tungsten.

The sintered compact was made from tungsten that contained the emitter (other than thorium) at a high concentration (from 10 to 80 weight %). The diameter was 2 mm, and the length was 5 mm. The sintered compact was embedded in the main body part of the cathode.

The front end part was joined to the main body part by diffused junction (diffusion bonding).

Variations in the illuminance preserving factor were observed while the front end diameter of the cathode was changed and the lamp input was changed to change the current density.

FIG. 6 shows Table 3 that indicates the results of the experiments. The current density J was calculated by the equation of $J \equiv I/S$ ($A/mm^2$) where S represents a cross sectional area at a position 0.5 mm from the cathode front end, with the unit of $mm^2$, and I represents the lamp current with the unit of A. The cross sectional area S is calculated by the equation of $S=\pi r^2$ where the diameter was 2r at the position 0.5 mm from the cathode front end.

In the experiments, the lamp was lit with the anode taking an upper position than the cathode. The power source was a constant-current power source. The output of the power source was variable.

In Table 3, the cathode of the comparative example (comparison) 5 included cerium tungsten, which contained cerium oxide by two weight % and had 2 mm thickness, and cerium tungsten was joined to the front end of the main body part of the cathode. The main body part of the cathode was made from pure tungsten. In the comparative example (comparison) 6, the entire cathode was made from cerium tungsten, which contained cerium oxide by two weight %.

In FIG. 6 (Table 3), the illuminance preserving factor was evaluated to be good (o) if the illuminance preserving factor was no smaller than 90% after 100-hour lighting. Graph 1 in FIG. 7 shows the results of Table 2.

Figure 7:
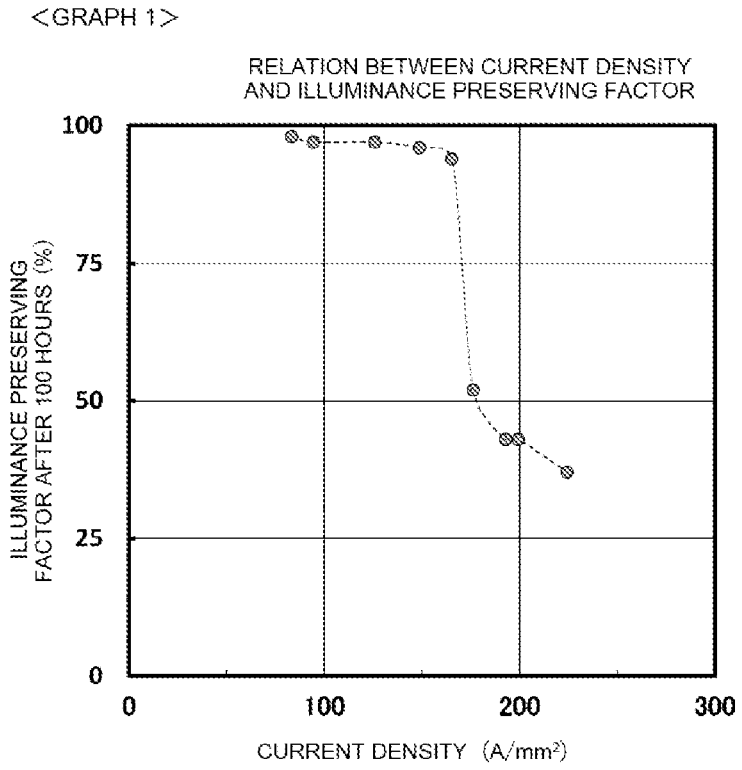
FIG. 7 is Graph 1 prepared from Table 3.

It is obvious from FIG. 6 (Table 3) and FIG. 7 (Graph 1) that the illuminance preserving factor steeply drops when the current density exceeds 165 $A/mm^2$. Then, the cathode performance deteriorates, and the blackening takes place soon.

From these phenomena, the inventors found that the illuminance preserving factor of the lamp emission strongly depended on the current density during the lighting, and reflected the emitter characteristics (work function, vaporization pressure, vaporization speed, generation or no generation of tungstate, and the like). The inventor also found that the good performance was demonstrated by the cathode when the current density J was no greater than 165 $A/mm^2$.

In an extremely high current density region (over 165 $A/mm^2$), the cathode operates at a high temperature such that the emitter reacts with tungsten to produce a compound having a low melting point (e.g., tungstate, a compound of two oxides, namely tungsten oxide and rare earth oxide). The inventors assume that vaporization of the compound having the low melting point causes the illuminance of the emitted light to drop.

In the comparative example 5, the front end part that contains the emitter was joined to the front end of the main body part of the cathode. With the cathode of the comparative example 5, the flicker was generated when the lighting continued 50 hours. Then, the experiment was stopped. The flicker was generated because the emitter was quickly depleted at the front end part.

In the comparative example 6, the entire cathode was made from tungsten that contained the emitter. With the cathode of the comparative example 6, the illuminance preserving factor dropped to 70% when 100 hours passed. The inventors assumed that this was because the emitter vaporized quickly at the front end of the cathode and the emitter was not smoothly supplied to the front end from the rear portion of the cathode despite the fact that the entire cathode contained the emitter.

In this manner, the upper limit of the current density was raised to 165 $A/mm^2$, and it was possible to obtain a thoria-free (thorium-free) discharge lamp that could keep a high illuminance preserving factor for a long time while emitting light at a high luminance.

A fourth embodiment of the present invention will be described below. The fourth embodiment is different from the first embodiment in that the sintered compact of the fourth embodiment contains, as the emitter, a rare earth complex oxide (composite oxide).

The rare earth complex oxide contains an oxide that includes oxygen and an element selected from Groups 4A, 5A and 6A in the periodic table.

The rare earth complex oxide is a compound of a metal having a high melting point and any of lanthanum oxide ($La_2O_3$), cerium oxide ($CeO_2$), gadolinium oxide ($Gd_2O_3$), samarium oxide ($Sm_2O_3$), praseodymium oxide ($Pr_6O_{11}$), neodymium oxide ($Nd_2O_3$) and yttrium oxide ($Y_2O_3$).

In the fourth embodiment, the sintered compact contains the rare earth complex oxide therein, and therefore the sintered compact is reduced to the emitter (metal) at a lower temperature than an ordinary oxide. Accordingly, the emitter is smoothly supplied from the sintered compact even when the cathode temperature is low, i.e., even during the start-up of the lighting of the lamp. Thus, the emitter depletion does not occur from the start-up of the lighting, and it is possible to ensure the stable lighting of the lamp.

Because the rare earth complex oxide contains an oxide that includes oxygen and an element selected from Groups 4A, 5A and 6A in the periodic table, the melting point of the complex oxide becomes lower than the melting point of the oxide. Thus, it is possible to obtain the advantages of the present invention in a reliable manner.

Because the rare earth complex oxide is a compound of a metal having a high melting point and any of lanthanum oxide ($La_2O_3$), cerium oxide ($CeO_2$), gadolinium oxide ($Gd_2O_3$), samarium oxide ($Sm_2O_3$), praseodymium oxide ($Pr_6O_{11}$), neodymium oxide ($Nd_2O_3$) and yttrium oxide ($Y_2O_3$), the melting point significantly drops as compared to the oxide. Thus, the reduction is expected to take place at a lower temperature.

In the fourth embodiment, the rare earth oxides that can be a raw material of the rare earth complex oxide are as follows: lanthanum oxide ($La_2O_3$), cerium oxide ($CeO_2$), gadolinium oxide ($Gd_2O_3$), samarium oxide ($Sm_2O_3$), praseodymium oxide ($Pr_6O_{11}$), and neodymium oxide ($Nd_2O_3$).

The exemplary rare earth complex oxides are as follows:

R: rare earth element (including the above-mentioned ones, and heavy rare earth)

R—W—O
R—Zr—O
R—Ta—O
R—Nb—O
R—Mo—O
R—Hf—O
R—Ti—O
or the like.

Among these, the preferred examples are R—W—O and R—Zr—O because they are relatively stable at a high temperature and the materials are inexpensive.

The rare earth complex oxide tends to have a lower melting point than the rare earth oxide. Some examples are indicated in Table 4 shown in FIG. 8.

The rare earth complex oxide is an oxide that is obtained from a solid phase reaction between a rare earth oxide and an oxide of other than the rare earth element (Groups 4A, 5A and 6A). When these two kinds of oxide are looked at in the state diagram, there is a general tendency that the melting point of the oxide that is obtained from the reaction of the two oxides is lower than the melting point of any of the two oxides. In particular, the melting point of the rare earth oxide is very high (over 2000 degrees C.), and therefore the rare earth complex oxide that is obtained from the solid phase reaction of the rare earth oxide tends to have a low(er) melting point. The stage diagrams of the two kinds of oxide were in fact examined, and the above-mentioned general tendency was observed in most of the cases.

The resulting rare earth complex oxide needs to have a lower melting point than the rare earth oxide. However, if the melting point is too low, which is the case of the R—B—O oxide, then a problem may occur, e.g., the reaction with W progresses too much. In order to avoid this, it is preferred that when the rare earth complex oxide is prepared, the oxide that reacts with the rare earth oxide has a lower melting point than the rare earth oxide and the melting point is approximately 1000 to 2000 degrees C. (in the examined range). Also, it is preferred that the oxide is made from a substance that does not react with W easily, and that the substance does not cause the diffusion of oxides other than the rare earth oxide easily. When the substance is selected in view of the above-described points, then the oxide that is made from W, Zr, Ta, Hf or Ti is preferred. These elements are generally the elements in Groups 4A, 5A and 6A.

As seen in Table 4 shown in FIG. 8, there is a tendency that the melting point of any of the rare earth complex oxides (W, Zr, Ta, Hf and Ti form the phases as the oxides) is lower than the melting point of the rare earth oxide. When the state diagrams of the respective oxides are observed, it can basically be said that the above-mentioned rare earth complex oxides have a tendency to possess a lower melting point than the rare earth oxide alone regardless of the composition.

Now, a method of fabricating the sintered compact 34 that contains the rare earth complex oxide will be described.

An appropriate amount of the rare earth oxide and an appropriate amount of an oxide of an element, which is selected from one of Groups 4A, 5A and 6A, are prepared in accordance with a composition of a rare earth complex oxide to be fabricated. The rare earth oxide and the oxide are mixed with each other and placed in a sintering pot. In many cases, the sintering process is carried out in the atmosphere at a temperature, which is calculated (decided) by multiplying its melting point by a value from 0.5 to 0.9. The resulting powder is taken out from the pot. Most of the powder has been sintered. Thus, the powder is pulverized to obtain the pulverized powder.

It should be noted that the rare earth complex oxide to be fabricated includes one kind of rare earth oxide and one kind of oxide, which is the oxide of any of Group 4A element, Group 5A element and Group 6A element, in the above-described embodiment, but the rare earth complex oxide to be fabricated may include a plurality of kinds of rare earth oxide and/or a plurality of kinds of oxide, which is the oxide of any of Group 4A element, Group 5A element and Group 6A element, if the melting point should be adjusted and/or the electron emission capability should be adjusted.

For example, $Gd_2O_3$ and $ZrO_2$ are mixed with each other at the ratio of 1:2, and this mixture is sintered at 1800 degrees C. to obtain $Gd_2Zr_2O_7$.

The powder of the rare earth complex oxide, which is obtained by the above-described method, and the powder of tungsten (W) are mixed with each other at the weight ratio of 1:1, and a binder (stearic acid) is added to this mixture. The rare earth complex oxide powder, the tungsten powder and the binder are pressed and molded in a mold. Then, a degreasing process and a main sintering process (at a temperature near 1800 degrees C.) are applied to obtain a tungsten sintered compact that contains, as the emitter, the rare earth complex oxide.

In this specification, the emitter concentration is calculated as a weight % concentration relative to the sintered compact 34 of the rare earth complex oxide.

The melting point of the resulting rare earth complex oxide is lower than the melting point of the rare earth oxide. For example, the melting point of Ce—W—O is literally 2030 degrees C. at the highest, and approximately 1020 degrees C. at the lowest. The melting point of Ce—Zr—O is approximately 2300 degrees C.

In either case, the melting point of the rare earth complex oxide is lower than 2600 degrees C., which is the reported maximum value of the melting point of $CeO_2$ (rare earth oxide).

Thus, when the lamp is operating, the temperature in the vicinity of the closed space of the cathode is maintained at a temperature close to the melting point. The inventors assume that as the temperature of the rare earth complex oxide such as Ce—W—O and Ce—Zr—O rises close to the melting point, the rare earth complex oxide becomes easy to diffuse in the porous tungsten inside the closed space. As the rare earth complex oxide permeates or penetrates through the porous tungsten, it easily moves to the cathode front end, which is the high temperature side in the porous tungsten.

In this manner, the emitter is supplied smoothly and continuously. The inventor assume that the rare earth emitter such as Ce diffuses into tungsten of the front end part from that portion of the rare earth complex oxide which contacts the inner surface of the front end part. Thus, the emitter is conveyed to the cathode front end.

Likewise, other rare earth complex oxides are maintained at a high temperature but lower than the melting point, in order to smoothly supply the emitter to the cathode front end.

A fifth embodiment of the present invention will be described below. The value of the specific resistance of the front end part of the first embodiment will be defined.

Specifically, the specific resistance ρ of the front end part 32 of the cathode shown in FIG. 2 (measurement temperature T is 77 degrees K) is from 0.65 and 0.77 μΩ·cm in this embodiment. This value extends the life of the lamp with regard to the flicker.

If the specific resistance ρ of the front end part 32 has a high value, an amount of emitter supplied to the cathode front end from the sintered compact 34, which contains the emitter at a high concentration, increases. Thus, the emitter is depleted fast. In addition, adhesion of the emitter to the inner surface of the luminous tube increases. Thus, the output of the luminous flux attenuates quickly.

On the other hand, if the specific resistance ρ of the front end part 32 has a low value, an amount of emitter supplied to the cathode front end from the sintered compact, which contains the emitter at a high concentration, decreases. Thus, an amount of the emitter at the front end part becomes insufficient, and the depletion of the emitter occurs.

In general, the specific resistance ρ varies with a lattice defect, a lattice vibration, and other factors. The specific resistance ρ is expressed by the following equation.

$$\rho=\rho_1(\text{lattice defect})+\rho_2(\text{lattice vibration})+\rho_3(\text{other factors})$$

The specific resistance value will be examined with regard to the respective factors.

In many cases, the influence $\rho_2$ (lattice vibration) from the lattice vibration decreases in substantial proportion to the temperature T.

Other influences $\rho_3$ (other factors) have smaller values than the above-mentioned factors, but create a resistance due to scattering of electrons.

On the contrary, the influence $\rho_1$ (lattice defect) from the lattice defect creates a resistance that is produced by the scattering electrons because of impurities in the crystals and/or crystal grain boundary. This resistance does not vary with the temperature.

In this embodiment, the specific resistance ρ is measured at the absolute temperature 77 degrees K, and has a smaller influence from the lattice vibration than a specific resistance value measured at the room temperature. This specific resistance ρ measured at 77 degrees K has a value that reflects the influence of the lattice defects of the material of the front end part.

Factors that influence the specific resistance $\rho_1$ (lattice defect) due to the lattice defect at the front end part include, for example, grains of the additives (first emitter and the grain stabilizer) added to the front end part, impurities in the crystals, the crystal grain boundary, and distortion (strain) at the machining.

The influences from the lattice defect will now be described in detail.

When the front end part 32 is machined or processed, the front end part 32 contains a material (i.e., grain stabilizer) that suppresses the recrystallization after the machining.

For example, if an additive (grain stabilizer) for suppressing the recrystallization is not contained in the tungsten particles, and the front end part undergoes the processing such as pressing, molding, sintering and swaging, the recrystallization of the crystal grains progresses in the front end part and the crystal grains become coarse when, for example, the front end part is exposed to a high temperature (2200 degrees C. or higher), which corresponds to the temperature during the lighting of the lamp, for a long time. In some instances, most of the crystal grain boundary disappears (is lost). Thus, if no additive is added, the crystal grain boundary decreases with the operating time of the lamp, and the specific resistance ρ (lattice defect) decreases.

On the other hand, if the additive against the recrystallization is added, the additive disperses along the tungsten crystal grain boundary, and suppresses the losing of the crystal grain boundary due to the recrystallization of the tungsten grain. This is the pinning effect. As such, even when the heat treatment is carried out at a high temperature, the progress of the recrystallization is moderated or suppressed, and it is possible to suppress the coarsening of the crystal grain. Thus, the specific resistance $\rho_1$ (lattice defect) does not decrease easily when the lamp is emitting light.

The additive may be zirconium oxide ($ZrO_2$) or hafnium oxide ($HfO_2$), which is confirmed, by experiments, not to chemically react with tungsten at a temperature near the electrode operating temperature (2400 degrees C.). In this specification, the additive is referred to as a "grain stabilizer."

The material that is used as the first emitter contained in the front end part also reacts with tungsten and diffuses outward, but the material is still capable of suppressing the recrystallization while it is diffusing inside the front end part. This suppression of recrystallization is similar to zirconium oxide.

An amount of additive to be contained, which influences the specific resistance $\rho_1$ (lattice defect), is a sum of the first emitter and the grain stabilizer. For example, the amount of additive to be contained is preferably 0.1 weight % to 5.0 weight %, and more preferably 0.5 weight % to 3.5 weight %. The first emitter is used to ensure the good start-up when the lamp is first lit. The concentration of the first emitter is set to be low in order to prevent the excessive vaporization of the emitter due to exposure to the discharge arc.

When an amount of additive to be contained (i.e., a sum of the first emitter and the grain stabilizer) is greater than 5.0 weight %, the specific resistance $\rho$ at the front end part (T=77 degrees K) is greater than 0.77 $\mu\Omega\cdot$cm, which is the upper limit. If this additive is used in the front end part, the crystal grain boundary increases, and an amount of emitter to be conveyed to the cathode front end from the emitter sintered compact increases. Thus, although the emission at the cathode is good, the vaporization of the emitter increases, and adhesion of the emitter to the luminous tube increases. Accordingly, it is likely that the luminous tube is blackened or becomes clouded. This is unfavorable.

Also, the sintered compact of the front end part becomes fragile, and it is likely that breakage occurs due to cracking during the sintering process and/or the swaging process.

If the amount of additive to be contained (sum of the first emitter and the grain stabilizer) is less than 0.1 weight %, the specific resistance $\rho$ at the front end part (T=77 degrees K) is smaller than 0.65 $\mu\Omega\cdot$cm, which is the lower limit. If this additive is used in the front end part, an amount of contained emitter to be used for electron emission at the start-up of the lighting decreases. Along with that, the crystal grain boundary decreases, and therefore an amount of emitter to diffuse and move from the emitter sintered compact to the cathode front end decreases. As a result, the depletion of tungsten becomes significant, and an amount of tungsten that adheres to the luminous tube increases. This phenomenon can be recognized by a phenomenon that tungsten vaporizes and the blackening of the luminous tube increases.

The additive to be added to the front end part has a large electrical resistance than tungsten at room temperature, and in reality the additive is an insulator. Thus, when the additive is added, an effective cross-sectional area of tungsten is reduced, and the specific resistance tends to increase.

Figure 9:
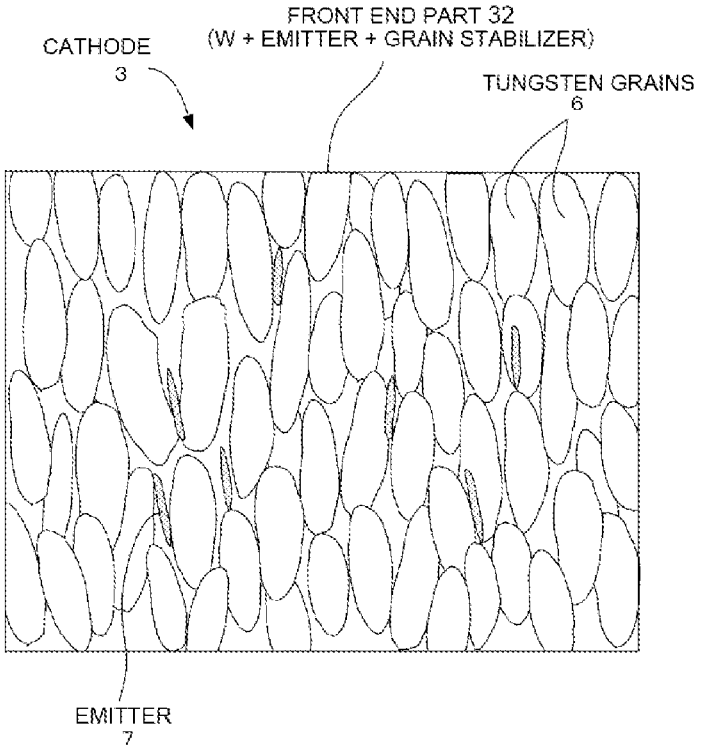
FIG. 9 is an enlarged view of a front end part of a cathode in a fifth embodiment of the present invention.

As shown in FIG. 9, the tungsten particles (grains) 6 are elongated vertically in the machining direction from their initial shape (spherical shape) because of the influence of the swaging. Thus, the tungsten particles have a larger aspect ratio. Also, the tungsten particles 6 are deformed or distorted, and the specific resistance $\rho_1$ (lattice defect) tends to increase. It should be noted that the emitter 7 is present along the grain boundary of the elongated tungsten particles 6.

Influences on the specific resistance from the additive of the front end part were examined, and the relation between these influences and the lamp longevity were examined.

The heat treatment was applied to the tungsten material in a vacuum at 2400 degrees K for 15 minutes when measuring the specific resistance.

A four-terminal method was used for measuring the voltage and the current. Then, the specific resistance was calculated based on the size of the tungsten material. The measurement was carried out in a liquid nitrogen (absolute temperature was 77 degrees K).

In the liquid nitrogen, it is possible to considerably suppress the influence on the specific resistance from phonon scattering (lattice vibration). Thus, the measured value of the specific resistance dominantly reflects the influence of an amount of additives, i.e., the measured specific resistance is $\rho_1$ (lattice defect).

The lamp that had the below-described cathode was evaluated.

Cathode outer diameter $\phi$ was 12 mm.

Cathode length in an axial direction was 21 mm.

Front end part dimension (length) in the axial direction was 2 mm.

Front end part material was tungsten doped with lanthanum oxide (emitter) and zirconium oxide (grain stabilizer).

Main body part dimension (length) in the axial direction was 19 mm.

Main body part material was tungsten doped with and zirconium oxide (grain stabilizer).

Sintered compact dimensions: Diameter was 2 mm, and length in the axial direction was 6 mm.

Sintered compact material was a mixture of cerium oxide and tungsten at the weight ratio of 1:2. The material was molded and sintered.

The additive (emitter and the grain stabilizer) to be contained in the front end part of the above-mentioned cathode was altered, and the specific resistance was altered. Then, the longevity of the lamp (life with regard to the flicker) was examined.

Results are indicated in Table 5 shown in FIG. 10. The lamp had a life of 100 hours or longer when the additive was added to tungsten of the front end part by 0.5 to 3.5 weight %. After the heat treatment in the vacuum at 2400 degrees K, the specific resistance was measured at the measurement temperature T (T=77 degrees K). The specific resistance was 0.65 to 0.77 $\mu\Omega\cdot$cm.

It is important to ensure the diffusion of the emitter. Thus, it is preferred that there are many crystal grain boundaries. However, if an amount of additive, which contains the emitter, becomes too large (5.0 weight % or more), the grain boundaries increase and the emitter concentration becomes high. As a result, an amount of emitter to be supplied to the cathode front end increases, and the emitter is depleted earlier. Further, the emitter is more vaporized, and a larger amount of emitter adheres to the inner surface of the luminous tube. Thus, the luminous tube becomes clouded, and the output of the luminous flux attenuates soon.

On the other hand, if an amount of additive that includes the emitter is small (equal to or less than 0.1 weight %), the opposite thing occurs. Specifically, the grain boundaries decrease, and the emitter concentration is low. Thus, the diffusion and feeding of the emitter to the front end becomes insufficient, the emitter is depleted early, and the lighting becomes poor. Also, the tungsten of the front end part vaporizes and adheres to the luminous tube. This results in the blackening of the luminous tube.

A sixth embodiment of the present invention will be described. In the sixth embodiment, the main body part and/or the front end part has a fibrous metallographic structure that is present in a region around the sintered compact and extends in an axial direction of the cathode.

When the rare earth element is used as the emitter, there is a problem that a substance that vaporizes from the emitter adheres to the inner surface of the luminous tube, and that this can cause devitrification (cause the clouding).

Figure 20:
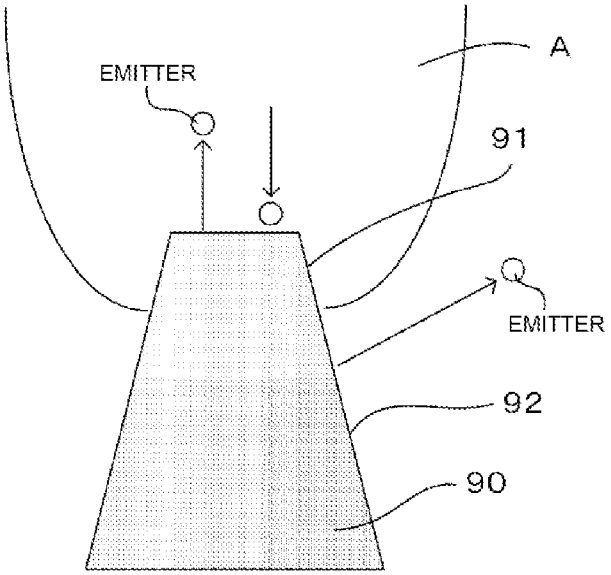
FIG. 20 is a cross-sectional view showing another conventional technique.

FIG. 20 illustrates a structure of an ordinary front end part of the cathode 90. As shown in this drawing, the arc A extends over a portion 91 of the front end of the cathode 90. At the portion 91, the vaporized emitter (rare earth element) ionizes and becomes a positive ion. Then, the positive ion returns to the cathode. This cycle is repeated. However, the emitter (rare earth element) vaporizing from a lateral face 92 of the cathode over which the arc A does not extend is released to the light emitting space without returning to the cathode 90. Thus, there is a problem, i.e., the emitter adheres to the inner surface of the luminous tube, and the devitrification (clouding) of the luminous tube occurs.

The cathode of the sixth embodiment intends to suppress the vaporization of the emitter from the lateral face of the cathode, over which the arc does not extend. As a result, the cathode of the sixth embodiment can prevent the devitrification (clouding) of the luminous tube.

For this reason, the main body part and/or the front end part of the cathode in the sixth embodiment includes a fibrous metallographic structure that extends in a region around the sintered compact embedded in the cathode. The fibrous metallographic structure extends in the axial direction of the cathode. The main body part is made from pure tungsten, which does not contain any emitter.

Having such structure, the emitter (rare earth oxide) contained in the sintered compact is difficult to diffuse in the radial direction of the cathode, and is forced to diffuse and move toward the front end. Accordingly, the feeding of the emitter to the cathode front end takes place smoothly and quickly. Thus, it is possible to prevent the depletion of the emitter at the front end part, and suppress the vaporization of the emitter from the lateral face of the cathode over which the arc does not extend. Consequently, the devitrification of the luminous tube is avoided.

Because the sintered compact is buried in the main body part, which is, in effect, made from the pure tungsten, that area over which the arc does not extend is made from tungsten. Thus, the exposure of the rare earth element is further suppressed in that area.

Figure 11A:
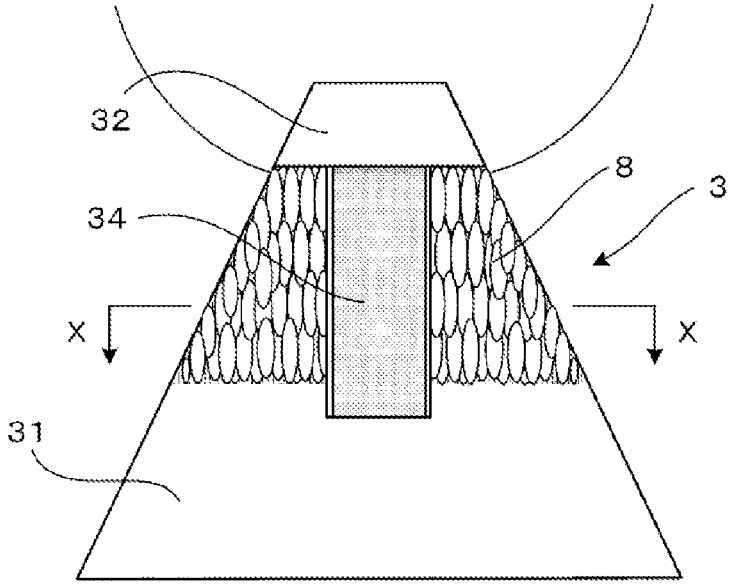
FIG. 11(A) is a cross-sectional view of the front end part of the cathode in a sixth embodiment of the present invention.
Figure 11B:
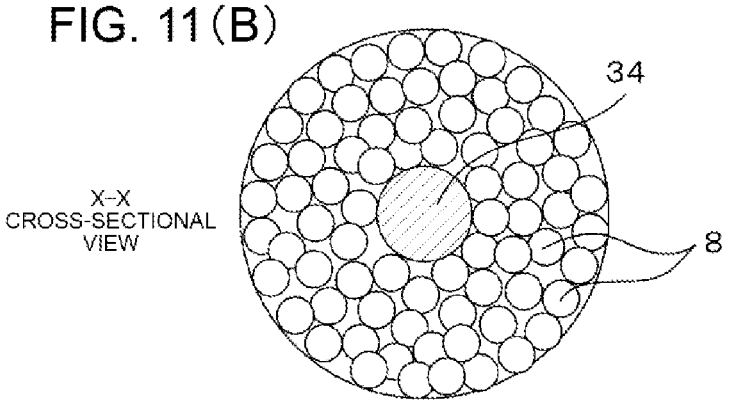
FIG. 11(B) is a cross-sectional view taken along the line X-X.

As shown in FIGS. 11(A) and 11(B), the fibrous metallographic structure 8 is formed around the longitudinal lateral face of the sintered compact 34 embedded in the cathode 3. The sintered compact 34 contains the emitter (except thorium) at a high concentration. The fibrous metallographic structure 8 extends substantially the entire length of the sintered compact 34. The fibrous metallographic structure 8 has a plurality of crystal grains or particles that are elongated in the axial direction of the cathode 3. In this embodiment, the sintered compact 34 is substantially buried in the main body part 31. Thus, the fibrous metallographic structure 8 is formed in the main body part 31, which is made from the pure tungsten.

As described above, the emitter diffuses from the sintered compact 34 and is conveyed to the front end part 32. It should be noted here that the diffusion of the emitter from the sintered compact 34 occurs not only from the front end thereof but also from the lateral face thereof. However, the fibrous metallographic structure 8 that extends in the axial direction of the cathode 3 and is present around the sintered compact suppresses or restricts the diffusion of the emitter in the radial direction and forces the emitter to move in the longitudinal axial direction.

Therefore, the emitter from the sintered compact 34 is only allowed to move toward the front end part 32. The emitter is conveyed and supplied to the front end part 32 in a sufficient amount that corresponds to the consumption of the emitter at the front end part 32. Thus, the emitter is not depleted. In addition, the conveyance of the emitter in the radial direction is suppressed. Thus, the vaporization of the emitter from the tapered lateral face of the cathode 3 is reduced to the minimum, and it is possible to suppress or prevent the luminous tube from becoming clouded.

Figures 12A, 12B:
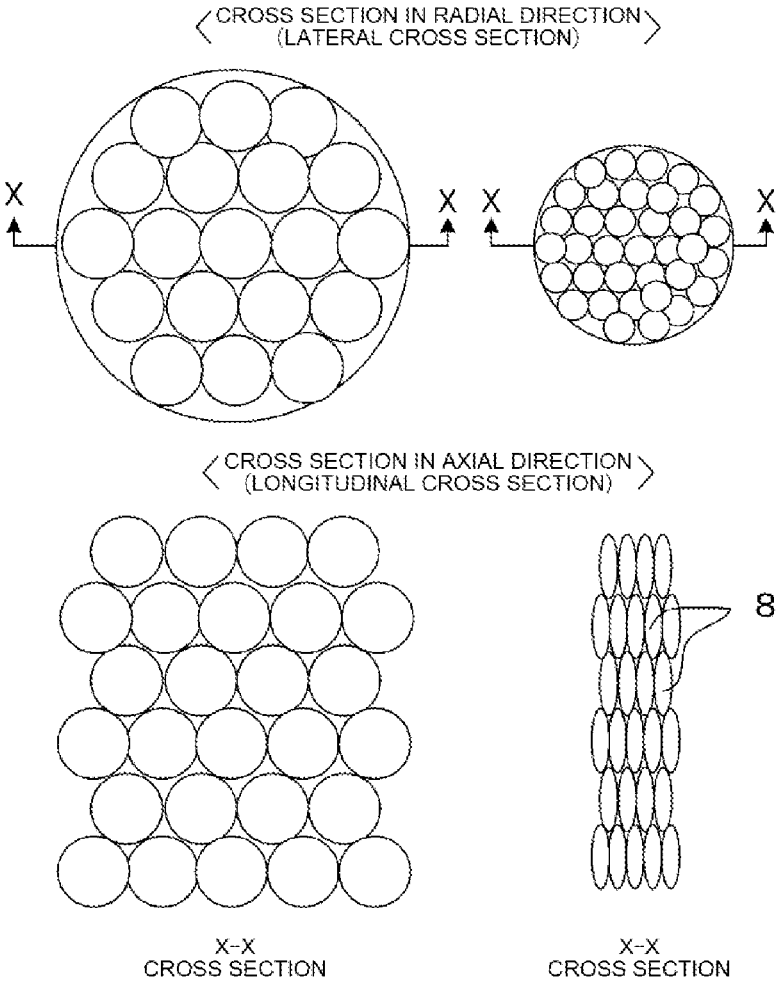
FIG. 12(A) is a set of cross-sectional views before a fibrous metallographic structure is formed.
FIG. 12(B) is a set of cross-sectional views after the fibrous metallographic structure is formed.

A method of fabricating such fibrous metallographic structure 8 will be described with reference to FIGS. 12(A) and 12(B).

An impurity (e.g., potassium) is added to the tungsten powder, which is the constituent material of the cathode, and the tungsten powder is reduced. The powder is then put through a sieve to regulate the particle size and mix the powder. The mixed powder becomes a compressed powder (compact) at a pressure of approximately 1000 atmospheric pressure. The compressed powder is sintered in a high temperature furnace, and becomes a sintered compact. As shown in FIG. 12(A), the tungsten particles in the sintered compact have substantially the same length in the vertical (height) and horizontal (width) directions. In other words, the aspect ratio (length in the axial direction/length in the radial direction) is approximately one.

The sintered compact is swaged from the lateral surface in an atmosphere of, for example, 1300 degrees C. to 1500 degrees C. Then, the sintered compact shrinks in a cross section in the swaged direction, and is elongated in the axial direction. In other words, the particle shape in the sintered compact becomes thin in the radial direction and elongated in the axial direction during the swaging process to the tungsten (deformation processing, plastic working). Thus, the fibrous metallographic structure 8 shown in FIG. 12(B) is obtained. By continuing (repeating) the swaging process, the particle shape in the sintered compact is further elongated, and the aspect ratio is further increased. In this manner, a desired aspect ratio is obtained by the swaging process. It should be noted that every time the sintered compact undergoes the swaging process, the sintered compact is heated to a temperature equal to or lower than the recrystallization temperature for annealing. Thus, it is possible to obtain a tungsten base structure that is long in the axial direction and short in the radial direction, and that is made from the fibrous metallographic structure.

By repeating the swaging process, the theoretical density of tungsten becomes high (99% or more). In this embodiment of the invention, the theoretical density is preferably no smaller than 98%, more preferably no smaller than 99%, and further preferably no smaller than 99.8%, in at least a high melting point metallic portion of the fibrous metallographic structure.

Although the sintered compact 34 is received in the main body part 31 in FIG. 11(A), the sintered compact 34 may partly be received in the main body part 31 and partly be received in the front end part 32 as shown in FIG. 2(B). In this configuration, the fibrous metallographic structure may also be present in both of the main body part 31 and the front end part 32.

Alternatively, as shown in FIG. 2(C), the sintered compact 34 may be received (embedded) in the front end part 32. In this configuration, the fibrous metallographic structure may be formed in the front end part 32.

The fibrous metallographic structure 8 extends along almost the entire length of the sintered compact 34. In practice, however, a sufficient effect and advantage can be expected if the fibrous metallographic structure is present in a 5 mm range (backward) from the front end face of the sintered compact.

This is because the sintered compact 34 is embedded in the tapered portion of the cathode 3, and the temperature steeply drops as the temperature measuring point moves backward from the cathode front end (several hundred degrees K/mm). It is significant that the diffusion of the emitter from the sintered compact is not seen in an area after the 5 mm range from the front end of the sintered compact 34. Also, because the temperature is low, the sintered compact does not melt.

A seventh embodiment of the present invention will be described with reference to FIGS. 13 to 15(H).

In the seventh embodiment, a rhenium-tungsten alloy part is formed at the front end of the cathode.

At the front end part of the cathode, which has an extremely high temperature at the start-up lighting of the lamp, the recrystallization of the crystal grains may progress and the grain boundaries may disappear. However, the rhenium-tungsten alloy part is provided at the front end face of the front end part which faces the anode, and the rhenium-tungsten alloy part has a higher recrystallization temperature than an ordinary tungsten. Thus, the recrystallization is suppressed at the rhenium-tungsten alloy part even in the high temperature condition. In this manner, the crystal grain boundaries are maintained (preserved), and the diffusion of the emitter from the sintered compact along the grain boundaries is not hindered.

Figure 13:
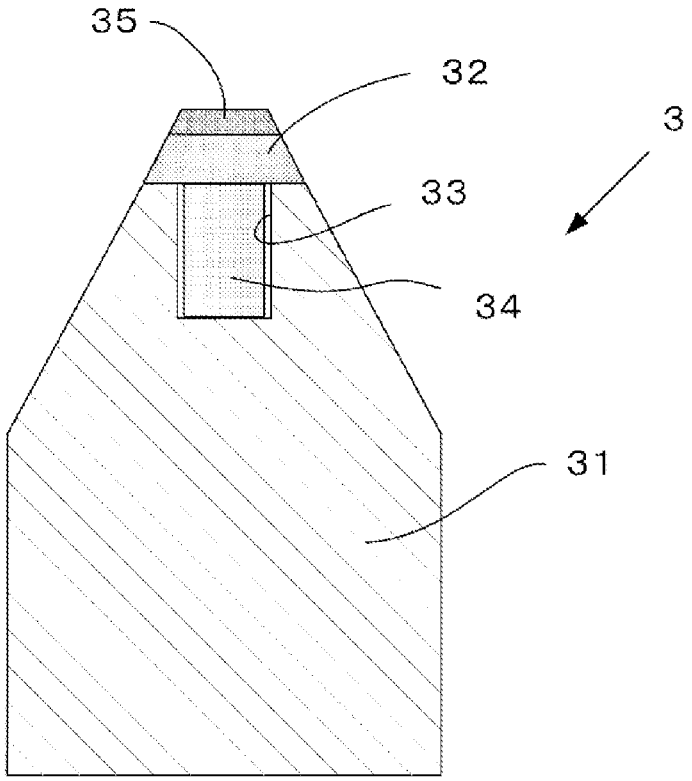
FIG. 13 shows a cathode configuration in a seventh embodiment of the present invention.

In FIG. 13, the cathode 3 includes the main body part 31, which is made from a metallic material having a high melting point and which does not contain thorium, and the front end part 32 joined to the main body part 31. This is similar to each of the above-described embodiments. The front end part 32 contains an appropriate amount of emitter (except thorium).

In the closed space 33 defined in the main body part 31, embedded is the sintered compact 34 that contains the second emitter (except thorium) at a higher concentration than the first emitter contained in the front end part 32.

The rhenium-tungsten alloy part 35 is attached to the front end face of the front end part 32 of the cathode 3. The rhenium-tungsten alloy part 35 is made from an alloy (Re—W) of rhenium (Re) and tungsten (W).

The rhenium-tungsten alloy has a higher recrystallization temperature than an ordinary tungsten. Thus, the rhenium-tungsten alloy is hardly recrystallized even during the lighting (in a high temperature condition), and maintains the crystal grain boundaries so that the feeding passages for the second emitter is maintained.

Figure 14A:
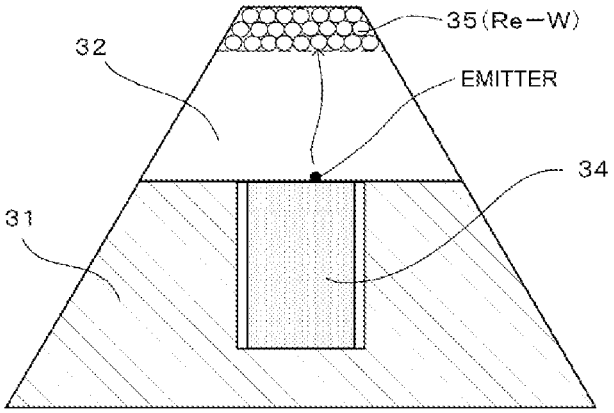
FIG. 14(A) is a view useful to describe an advantage of the seventh embodiment of the present invention.
Figure 14B:
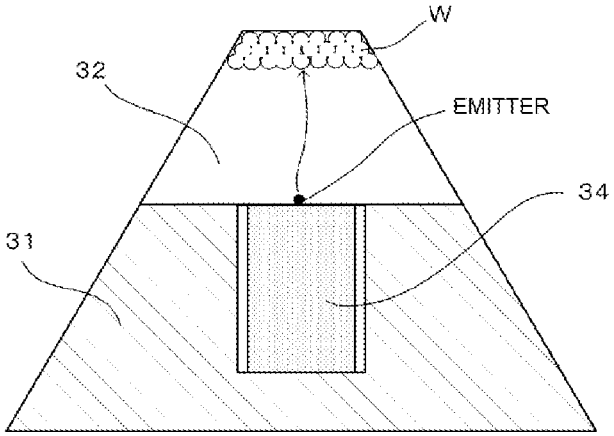
FIG. 14(B) shows a comparative example.

The function and advantage of the seventh embodiment will be described with reference to FIGS. 14(A) and 14(B). FIG. 14(A) shows the seventh embodiment, and FIG. 14(B) shows a comparative example, i.e., configuration that does not have a Re—W alloy part.

Upon turning on of the lamp (lighting start-up of the lamp), the front end of the cathode 3 has an extremely high temperature (2400 degrees K or higher). As illustrated in FIG. 14(B), the tungsten crystal grains (particles) in the front end part 32 may be recrystallized due to this high temperature. If the recrystallization proceeds, the grain boundaries of the crystal grains may be lost, and the feeding passages of the second emitter diffusing from the sintered compact 34 along the grain boundaries may be closed. As a result, the feeding of the second emitter to the front end face may not take place smoothly.

In order to avoid such situation, the seventh embodiment includes the rhenium-tungsten alloy part 35 at the front end face of the front end part 32, as shown in FIG. 14(A). The rhenium-tungsten alloy part 35 is made from an alloy (Re—W) of rhenium (Re) and tungsten (W).

The rhenium-tungsten alloy has a higher recrystallization temperature than a normal tungsten. Thus, the rhenium-tungsten alloy is little recrystallized at a high temperature during the lighting start-up period. Accordingly, the rhenium-tungsten alloy maintains the crystal grain boundaries, and maintains the supply paths of the second emitter to the front end face. As such, the emitter is supplied to the front end face smoothly.

The rhenium-tungsten alloy part 35 may only be provided at the front end face of the front end part 32. Specifically, it is satisfactory if the rhenium-tungsten alloy part 35 is provided in a 0.5 mm thickness (or in a greater thickness) from the front end toward the rear end of the front end part 32.

This is because the short arc discharge lamp, to which the present invention is applied, has a significantly large temperature gradient at the cathode front end. As the distance increases from the cathode front end, the temperature steeply drops to a value below the recrystallization temperature of the tungsten crystal grains.

It should be noted that the rhenium-tungsten alloy part 35 may contain the same (or similar) emitter as (to) the first emitter contained in the front end part 32.

As described above, it is sufficient that the rhenium-tungsten alloy part 35 has a thickness equal to or greater than 0.5 mm. It should be noted, however, that the entire front end part 32 may be made from the rhenium-tungsten alloy, and may additionally contain the first emitter. Then, the front end part 32 may be joined to the main body part 31.

A method of manufacturing the cathode of the seventh embodiment will be described with reference to FIGS. 15(A) to 15(H).

Figure 15A:
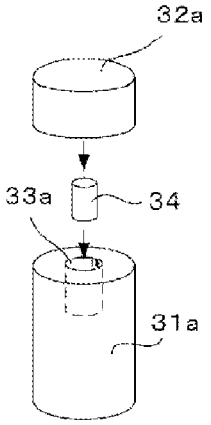
FIG. 15(A) to FIG. 15(H) are a set of views useful to describe a method of manufacturing the cathode in the seventh embodiment of the present invention.

Firstly, as shown in FIG. 15(A), a hole 33*a* is formed in the front end of the main body member 31*a*, which will eventually become the main body part 31. The hole 33*a* will eventually become the closed space 33. The sintered compact 34 is placed into the hole 33*a*. Then, the front end member 32*a*, which will constitute the front end part 32, is brought into contact with the sintered compact 34.

Figure 15B:
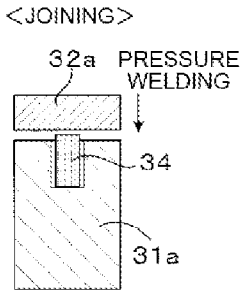

In this situation, as shown in FIG. 15(B), the upper end of the sintered compact 34 protrudes from the surface of the main body part 31 by a small amount (e.g., approximately 0.5 mm).

The front end member 32*a* is pressed to compress the sintered compact 34 such that the front end member 32*a* abuts against the main body member 31*a*. With this condition, the front end member 32*a* is joined to the main body member 31*a* by diffused junction (diffusion bonding), resistance welding or the like.

Figure 15C:
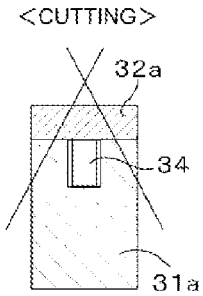

Subsequently, as shown in FIG. 15(C), the front end of the cathode 3 is cut by machining after the front end member 32*a* is joined to the main body member 31*a*.

Figure 15D:
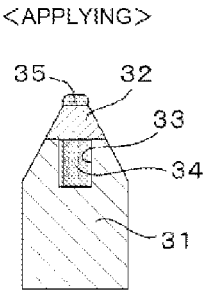

Then, as shown in FIG. 15(D), a liquid is applied onto the front end face of the front end part 32 after the cutting. The liquid contains a rhenium powder, cellulose nitrate and butyl acetate, and the rhenium powder is dispersed in a mixture of cellulose nitrate and butyl acetate.

Figure 15E:
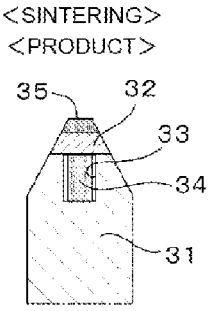

As shown in FIG. 15(E), the front end part 32 and the main body part 31 are heated in the vacuum at a temperature between 2200 and 2400 degrees C. (sintering process) such that rhenium is dissolved in tungsten by this vacuum heat treatment. Thus, the rhenium-tungsten alloy part 35 is formed. In this manner, the final product is provided.

Another method of fabricating the rhenium-tungsten alloy part 35 will be described with FIGS. 15(F) to 15(H).

Figure 15F:
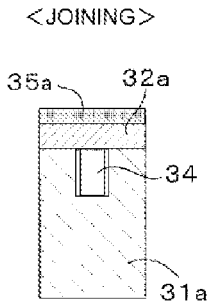

As illustrated in FIG. 15(F), after the main body member 31*a* is joined with the front end member 32*a*, a rhenium-tungsten alloy plate 35*a* is joined to the front (upper) end of the front end member 32*a*.

Figure 15G:
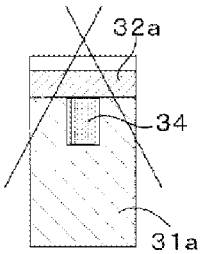

Then, the front end part of the cathode 3 is cut by machining, as shown in FIG. 15(G).

Figure 15H:
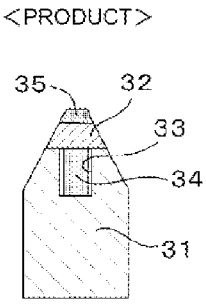

As a result, the front end part 32 is joined to the upper end of the main body part 31 as shown in FIG. 15(H). Also, the rhenium-tungsten alloy part 35 is formed on the upper end face of the front end part 32, and the sintered compact 34 is sealedly embedded in the inner closed space 33 of the cathode 3. In this manner, the final shape (configuration) of the cathode 3 is obtained.

Voltage variations were evaluated with the short arc discharge lamp that used the cathode configuration of the seventh embodiment.

In the lamp used for the experiments, the cathode of the seventh embodiment of the present invention included the above-described rhenium-tungsten alloy part. A cathode of a comparative example included no rhenium-tungsten alloy part.

Lamp used: Xenon lamp
Input: 4.9 kW
Cathode outer diameter: 12 mm
Cathode length in axial direction: 21 mm
Taper angle: 40 degrees Results of the experiments are shown in Table 6.

TABLE 6

| | Time | Voltage Variation |
|---|---|---|
| R—W absent | 1 hour | 0.8 V |
| Comparative Example | 100 hours | 1.2 V or more |
| R—W present | 1 hour | 0.6 V |
| Invention | 100 hours | 0.8 V |

As obvious from Table 6, the voltage variation of the comparative example (Re—W absent) from the initial voltage was 0.8 V when approximately one hour passed from the start of the lighting. The voltage variation of the comparative example exceeded 1.2 V when 100 hours passed.

On the contrary, the voltage variation of the embodiment of the present invention (Re—W present) was 0.8 V when 100 hours passed from the start of the lighting. This value is similar to the voltage variation of 0.6 V which was measured at the start-up.

From these observations, it is understood that the Re—W alloy part is useful and effective to stabilize the capability (characteristic) of the electron emission from the cathode. The inventor assumed that because Re was contained in W, the crystal growth of W was suppressed or regulated. Thus, the inventors assumed that the second emitter diffused to the front end part from the sintered compact in a smoother manner than the cathode that contained no Re, and therefore the voltage variation was suppressed.

It should be noted that the sintered compact 34 is embedded in the main body part 31 of the cathode 3 in the embodiment shown in FIG. 13, but the present invention is not limited to such configuration. For example, as shown in FIG. 2(B), the sintered compact 34 may be buried in the cathode 3 such that the sintered compact 34 extends between the main body part 31 and the front end part 32. Alternatively, as shown in FIG. 2(C), the sintered compact 34 may be received in the front end part 32.

In any of these embodiments, the distance between the front end (upper end) of the sintered compact 34 and the front end of the cathode 3 is preferably in a range from 1.5 mm to 5.0 mm.

An eighth embodiment of the present invention will now be described. In the eighth embodiment, the grain boundary density of tungsten that constitutes the front end part 32 is defined, and the concentration gradient of the emitter from that portion of the front end part which abuts onto the sintered compact to the front end face is defined.

Specifically, the product of A and B satisfies:

$$260\times10^{-9}\ (\mathrm{mol/mm^5})\leq A\times B\leq 670\times10^{-9}\ (\mathrm{mol/mm^5})$$

where A ($\mathrm{mm^{-1}}$) represents a grain boundary density of tungsten in the front end part, and B ($\mathrm{mol/mm^4}$) represents a concentration gradient of the emitter from that point of the front end part which contacts the sintered compact, to the front end face.

When the cathode configuration of the first embodiment is employed, the inventors acquired some knowledge with regard to the diffusion of the emitter to the front end face of the front end part 32 from the sintered compact 34. Specifically, with regard to the relation between an amount of diffusing emitter and the grain boundary density of tungsten, which was the constituent material of the front end part, the inventors found that an amount of diffusing emitter generally increased in proportion to the increasing grain boundary density. Thus, if the grain boundary density is too high, an amount of diffusing emitter would become excessive, and if the grain boundary density is too low, an amount of diffusing emitter would become too small.

In other words, if the grain boundary density falls within an appropriate range, it is possible to regulate the vaporization of the emitter from the cathode front end, prevent the depletion of the emitter, and maintain proper light emission for a long time.

In the embodiment(s) of the present invention, the grain boundary density (A) of the tungsten grains (particles), which constitute the front end part of the cathode, falls within a range of 120 to 430 $\mathrm{mm^{-1}}$.

In this specification, the grain boundary density of the tungsten grains is the grain boundary density of the tungsten grains in an inner area of the front end part of the cathode.

On the other hand, with regard to the relation between an amount of diffusion of the emitter and the concentration gradient of the emitter in the front end part, an amount of diffusion of the emitter generally increases in proportion to the increasing concentration gradient.

Therefore, if the concentration gradient is too large, an amount of diffusion of the emitter becomes too large, and if the concentration gradient is too small, an amount of diffusion of the emitter becomes too small.

Figure 16:
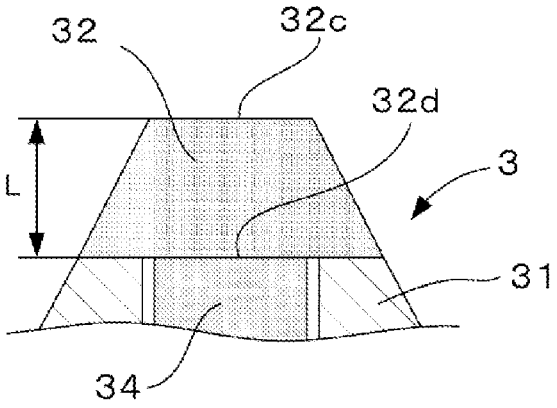
FIG. 16 is an enlarged view of a front end part of the cathode according to an eighth embodiment of the present invention.

A method of calculating the concentration gradient will be described with reference to FIG. 16.

It should be assumed that the emitter concentration at that portion 32*d* of the front end part 32 which abuts against the sintered compact 34 is $N_0$.

The concentration (B) of the emitter contained in the sintered compact 34 falls in a range that satisfies the equation of 10 wt %≤B≤80 wt %. The emitter concentration No of when the emitter concentration (B) of the sintered compact 34 is 30 wt % is obtained from a diffusion equation, using an amount of the emitter diffusing to tungsten that is obtained from an analysis result. Then, the calculation provides that $N_0=3.76\times10^{-9}$ (mol/mm$^3$).

At this point in time, the emitter concentration N at the upper end face 32*c* of the front end part 32 is about zero. As the distance L from the upper end of the sintered compact 34 to the upper end face 32*c* of the front end part 32 changes, the concentration gradient (B) changes. When the distance L changes from 1 mm to 6 mm, the concentration gradient takes the values shown in Table 1.

TABLE 7

| Distance from Sintered Compact Front End to Cathode Front End Face (mm) | Concentration Gradient ($\times10^{-9}$ mol/mm$^4$) |
|---|---|
| 6 | 0.63 |
| 5 | 0.75 |
| 4 | 0.94 |
| 3 | 1.3 |
| 2 | 1.9 |
| 1 | 3.8 |

The emitter concentration No at that portion 32*d* of the front end part 32 which abuts against the sintered compact 34 varies with an amount of the emitter contained in the sintered compact 34 and the grain boundary density, but the range of the variations is generally (1.25 to 10.03)$\times10^{-9}$ (mol/mm$^3$).

As described above, an amount of diffusion of the emitter depends upon the grain boundary density and the concentration gradient, and therefore a product of the grain boundary concentration and the concentration gradient (grain boundary concentration x concentration gradient) is used as an index thereof.

Cathodes were prepared with the grain boundary density (A) being 120 to 430 (mm$^{-1}$) and the concentration gradient (B) being (0.63 to 3.8)$\times10^{-9}$ (mol/mm$^3$), and these cathodes were assembled in lamps. The longevities of these lamps were then examined. Here, the life of the lamp or the longevity is represented by time till the illuminance preserving factor drops to 60% or time till the voltage variation becomes equal to or greater than a prescribed or defined value (1.2 V). The prescribed voltage value is an index to indicate the generation of the flicker.

Table 8 shown in FIG. 17 indicates the results. In Table 8, the evaluation "o" indicates that the longevity of the lamp is equal to or longer than 300 hours, and the evaluation "@" or double circle indicates that the longevity of the lamp is equal to or longer than 400 hours.

Figure 18:
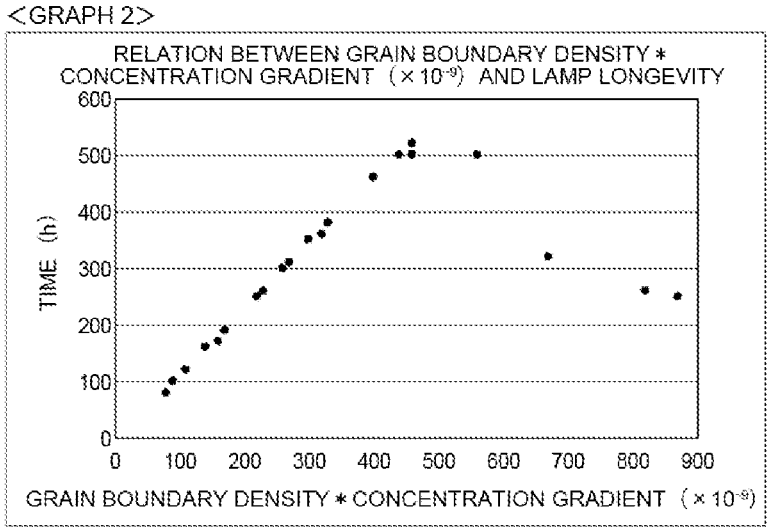
FIG. 18 is Graph 2 prepared from Table 8.
Figure 19:
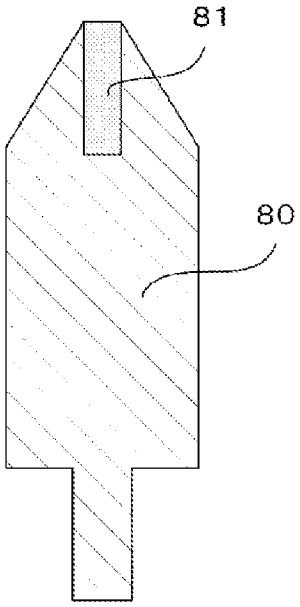
FIG. 19 is a cross-sectional view showing a conventional technique.

These results are shown in Graph 2 in FIG. 18.

It is understood from FIG. 17 (Table 8) and FIG. 18 (Graph 2) that when the product of grain boundary density A and the concentration gradient B falls within a range from $260\times10^{-9}$ to $670\times10^{-9}$ (mol/mm$^5$), a satisfactory lamp longevity (equal to or longer than 300 hours) is obtained.

More preferably, when the product of grain boundary density A and the concentration gradient B falls within a range from $400\times10^{-9}$ to $560\times10^{-9}$ (mol/mm$^5$), a more satisfactory lamp longevity (equal to or longer than 400 hours) is obtained.

In the eighth embodiment, the sintered compact 34 may not be necessarily embedded in the main body part 31. This is similar to the above-described embodiments. For example, the sintered compact 34 may be embedded in the cathode such that the sintered compact extends between the main body part 31 and the front end part 32, or such that the sintered compact is entirely received in the front end part 32.

REFERENCE NUMERALS AND SYMBOLS

1: Discharge lamp
2: Luminous tube
3: Cathode
31: Main body part
32: Front end part
33: Closed space
34: Sintered compact
35: Rhenium-tungsten alloy part
4: Anode
5: Reducing agent
51: Foil reducing agent
52: Powder reducing agent
53: Powder reducing agent
6: Tungsten particles
7: Emitter
8: Fibrous metallographic structure

The invention claimed is:

1. A discharge lamp comprising a cathode and an anode, facing each other in a luminous tube, the cathode having a main body part and a front end part joined to a front end of the main body part, the main body part being made from a metallic material having a high melting point and containing no thorium, the front end part being made from a metallic material having a high melting point and containing a first emitter (except thorium), a sintered compact material being received in a hermetically sealed closed space formed in the main body part and/or the front end part, the sintered compact material containing a second emitter (except thorium) in a higher concentration than the first emitter contained in the front end part.

2. The discharge lamp according to claim 1, wherein each of the first emitter contained in the front end part and the second emitter contained in the sintered compact material is any of lanthanum oxide ($La_2O_3$), cerium oxide ($CeO_2$), gadolinium oxide ($Gd_2O_3$), samarium oxide ($Sm_2O_3$), praseodymium oxide ($Pr_6O_{11}$), neodymium oxide ($Nd_2O_3$) and yttrium oxide ($Y_2O_3$), or a combination thereof.

3. The discharge lamp according to claim 1, wherein an emitter concentration (CF) of the first emitter in the front end part satisfies that 0.5 weight % <CF <5weight %, an emitter concentration (CB) of the second emitter in the sintered compact material satisfies that 10 weight % ≤CB ≤80 weight %, and CF is smaller than CB.

4. The discharge lamp according to claim 1, wherein a reducing agent is sealedly disposed in the hermetically sealed closed space to reduce the sintered compact material and the second emitter contained in the sintered compact material.

5. The discharge lamp according to claim 4, wherein the reducing agent includes titanium (Ti), tantalum (Ta), vanadium (V), or niobium (Nb).

6. The discharge lamp according to claim 1, wherein the front end part is made from tungsten, the second emitter contained in the sintered compact material is cerium oxide, and a distance between a front end of the cathode and a front end of the sintered compact material is 1.5 mm to 3.5 mm.

7. The discharge lamp according to claim 1, wherein the front end part of the cathode has a truncated cone shape, and a following equation is established:

$$165 \geq I/S(A/mm^2)$$

where S represents a cross section of the cathode at a position of 0.5 mm from a front end of the cathode and has a unit of $mm^2$, and I represents a lamp current and has a unit of A (ampere).

8. The discharge lamp according to claim 1, wherein the sintered compact material includes a rare earth complex oxide.

9. The discharge lamp according to claim 8, wherein the rare earth complex oxide contains an oxide that includes oxygen and an element selected from Groups 4A, 5A and 6A in a periodic table.

10. The discharge lamp according to claim 8, wherein the rare earth complex oxide includes a compound of a metal having a high melting point and any of lanthanum oxide ($La_2O_3$), cerium oxide ($CeO_2$), gadolinium oxide ($Gd_2O_3$), samarium oxide ($Sm_2O_3$), praseodymium oxide ($Pr_6O_{11}$), neodymium oxide ($Nd_2O_3$) And yttrium oxide ($Y_2O_3$).

11. The discharge lamp according to claim 1, wherein a specific resistance ρ of the front end part is 0.65 to 0.77 μΩcm when a measuring temperature T is 77 degrees K.

12. The discharge lamp according to claim 11, wherein the front end part is made from tungsten, and the front end part contains a grain stabilizing agent (zirconium oxide or hafnium oxide) To restrict or regulate crystal growth of tungsten.

13. The discharge lamp according to claim 1, wherein the main body part and/or the front end part includes a fibrous metallographic structure formed in an area around the sintered compact material, and the fibrous metallographic structure extends in an axial direction of the cathode.

14. The discharge lamp according to claim 13, wherein a front end face of the sintered compact material contacts the front end part in the hermetically sealed closed space, and the fibrous metallographic structure is formed in a 5 mm backward region from the front end face of the sintered body.

15. The discharge lamp according to claim 1, wherein the front end part is made from tungsten, and a rhenium-tungsten alloy part is formed at that front end face of the front end part which faces the anode.

16. The discharge lamp according to claim 15, wherein a thickness of the rhenium-tungsten alloy part is equal to or greater than 0.5 mm.

17. The lamp according to claim 1, wherein the front end part is made from tungsten, and a product (A×B) of a grain boundary density A ($mm^{-1}$) of tungsten in the front end part and a concentration gradient B ($mol/mm^4$) of the first emitter from that point of the front end part which contacts the sintered compact material, to a front end face of the front end part satisfies a following equation:

$$260\times10^{-9}(mol/mm^5) \leq A\times B \leq 670\times10^{-9}(mol/mm^5).$$

* * * * *